US012753966B2

(12) United States Patent
Cho et al.

(10) Patent No.: US 12,753,966 B2
(45) Date of Patent: Oct. 6, 2026

(54) REFRIGERATOR

(71) Applicant: SAMSUNG ELECTRONICS CO., LTD., Suwon-si (KR)

(72) Inventors: Woochul Cho, Suwon-si (KR); Byungsu Kim, Suwon-si (KR); Jinhong Yu, Suwon-si (KR); Wanhyeong Lee, Suwon-si (KR); Minseok Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 230 days.

(21) Appl. No.: 18/336,719

(22) Filed: Jun. 16, 2023

(65) Prior Publication Data

US 2024/0053090 A1 Feb. 15, 2024

Related U.S. Application Data

(63) Continuation of application No. PCT/KR2023/007486, filed on Jun. 1, 2023.

(30) Foreign Application Priority Data

Aug. 11, 2022 (KR) ..... 10-2022-0100913

(51) Int. Cl.
*F25D 25/02* (2006.01)
*A47B 88/40* (2017.01)
(Continued)

(52) U.S. Cl.
CPC ..... *F25D 25/025* (2013.01); *A47B 88/467* (2017.01); *F25D 11/02* (2013.01);
(Continued)

(58) Field of Classification Search
CPC ..... F25D 25/025; F25D 11/02; F25D 17/065; F25D 2400/16
See application file for complete search history.

(56) References Cited

U.S. PATENT DOCUMENTS 2,781,216 A * 2/1957 Foley ..... F25D 23/087 292/251.5
2,928,145 A * 3/1960 Foley ..... E05C 19/161 49/478.1
(Continued)

FOREIGN PATENT DOCUMENTS

CN 106766599 A 5/2017
CN 107036389 A 8/2017
(Continued)

OTHER PUBLICATIONS

International Search Report and Written Opinion of the International Searching Authority dated Sep. 25, 2023, in connection with International Application No. PCT/KR2023/007486, 10 pages.
(Continued)

*Primary Examiner* — Christopher R Zerphey

(57) ABSTRACT

Provided is a refrigerator. The refrigerator includes a body including an opening formed in a front surface, a door rotatably coupled to the body and configured to open and close the opening of the body, a refrigerator compartment provided in a first inner space of the body, and a freezer compartment case provided with a freezer compartment to insert into or withdraw from a second inner space of the body that is disposed under the first inner space, and configured to slide in a forward-backward direction between an insertion position at which the freezer compartment case is inserted into the second inner space and closes the freezer compartment and a withdrawal position at which the freezer compartment case is withdrawn from the second inner space and opens the freezer compartment, and a front of the freezer compartment case is covered by the door at the insertion position in a state in which the door closes the opening of the body.

14 Claims, 15 Drawing Sheets

(51) Int. Cl.

| | |
|---|---|
| ***A47B 88/467*** | (2017.01) |
| ***F25D 11/02*** | (2006.01) |
| ***F25D 17/06*** | (2006.01) |
| ***F25D 23/02*** | (2006.01) |
| ***F25D 23/06*** | (2006.01) |
| ***F25D 23/08*** | (2006.01) |

(52) U.S. Cl.
CPC .... *F25D 17/065* (2013.01); *A47B 2088/4015* (2017.01); *F25D 23/021* (2013.01); *F25D 23/025* (2013.01); *F25D 23/069* (2013.01); *F25D 23/087* (2013.01); *F25D 2317/061* (2013.01)

(56) References Cited

U.S. PATENT DOCUMENTS

| | | | | |
|---|---|---|---|---|
| 3,203,199 | A * | 8/1965 | Stewart | F25B 39/024 62/414 |
| 4,879,881 | A * | 11/1989 | Madigan | F25D 11/02 165/129 |
| 5,490,724 | A * | 2/1996 | Domenig | A47B 88/493 312/334.44 |
| 7,908,876 | B2 * | 3/2011 | Shin | F25D 23/12 62/62 |
| 8,015,839 | B2 * | 9/2011 | Kang | F25D 17/065 62/409 |
| 8,025,349 | B2 | 9/2011 | Lim et al. | |
| 8,028,538 | B2 * | 10/2011 | Kim | F25D 17/08 62/187 |
| 8,100,486 | B2 * | 1/2012 | Veltrop | A47B 88/40 312/402 |
| 8,172,346 | B2 * | 5/2012 | Tafoya | D06F 37/267 312/330.1 |
| 8,282,177 | B1 * | 10/2012 | Rotter | A47B 88/467 312/319.1 |
| 8,881,951 | B2 | 11/2014 | Hwang et al. | |
| 9,328,951 | B2 * | 5/2016 | Shin | F25D 25/025 |
| 9,885,202 | B2 * | 2/2018 | Laible | E05C 19/161 |
| 10,047,999 | B2 * | 8/2018 | Yang | F25D 23/067 |
| 10,203,151 | B2 * | 2/2019 | Cizik | F25D 23/069 |
| 10,408,528 | B2 * | 9/2019 | Hurlebaus | F25D 23/087 |
| 11,112,165 | B2 * | 9/2021 | Heckler | E05C 19/161 |
| 12,331,985 | B2 * | 6/2025 | Vellinga | F25D 23/028 |
| 2003/0107308 | A1 * | 6/2003 | Kueng | A47B 88/402 312/334.7 |
| 2006/0017360 | A1 * | 1/2006 | Lyvers | F25D 25/025 312/404 |
| 2008/0245079 | A1 * | 10/2008 | Lim | F25D 23/12 62/426 |
| 2010/0066226 | A1 | 3/2010 | Luisi et al. | |
| 2018/0073800 | A1 | 3/2018 | Okazaki et al. | |
| 2020/0300537 | A1 | 9/2020 | Park et al. | |

FOREIGN PATENT DOCUMENTS

| | | | |
|---|---|---|---|
| EP | 3712545 | A1 | 9/2020 |
| EP | 3355013 | B1 | 10/2020 |
| JP | 3869808 | B2 | 1/2007 |
| JP | 2008256342 | A | 10/2008 |
| JP | 2011085380 | A | 4/2011 |
| JP | 2013190136 | A | 9/2013 |
| JP | 2017072305 | A | 4/2017 |
| JP | 2018044756 | A | 3/2018 |
| KR | 20-1998-0032834 | U | 9/1998 |
| KR | 20-1997-0006719 | U | 11/1998 |
| KR | 20-1999-0024633 | U | 7/1999 |
| KR | 10-2003-0021795 | A | 3/2003 |
| KR | 10-2009-0012693 | A | 2/2009 |
| KR | 10-2011-0040572 | A | 4/2011 |
| KR | 10-2011-0122905 | A | 11/2011 |
| KR | 10-2015-0050542 | A | 5/2015 |
| KR | 20170093602 | A | 8/2017 |
| KR | 10-2020-0101185 | A | 8/2020 |
| KR | 10-2225075 | B1 | 3/2021 |

OTHER PUBLICATIONS

Supplementary European Search Report dated Jun. 17, 2025, in connection with European Patent Application No. 23852694.1, 8 pages.

* cited by examiner

REFRIGERATOR

CROSS-REFERENCE TO RELATED APPLICATIONS

This application is a bypass continuation of International Application No. PCT/KR2023/007486, filed Jun. 1, 2023, which claims priority to Korean Patent Application No. 10-2022-0100913, filed Aug. 11, 2022, the disclosures of which are herein incorporated by reference in their entirety.

BACKGROUND

1. Field

The present disclosure relates to a refrigerator.

2. Description of the Related Art

A refrigerator is an appliance that stores food in a fresh state by including a body having a storage compartment and a cold air supply system configured to supply cold air to the storage compartment. The storage compartment includes a refrigerator compartment maintained at a temperature of about 0 to 5° C. to refrigerate and store food and a freezer compartment maintained at a temperature of about −30 to 0° C. to freeze and store food. Generally, the storage compartment is provided to have an open front surface to allow food to be put in and taken out, and the open front surface of the storage compartment is opened and closed by a door.

The refrigerator repeats a cooling cycle in which a refrigerant is compressed, condensed, expanded, and evaporated using a compressor, a condenser, an expander, and an evaporator. Here, both the freezer compartment and the refrigerator compartment may be cooled by a single evaporator provided at the freezer compartment side, or an evaporator may be provided in each of the freezer compartment and the refrigerator compartment for the freezer compartment and the refrigerator compartment to be independently cooled.

Types of refrigerators may be classified according to the forms of the storage compartment and the door and may be classified into top mounted freezer (TMF) refrigerators in which a storage compartment is vertically divided by a horizontal partition and a freezer compartment is formed at an upper side and a refrigerator compartment is formed at a lower side and bottom mounted freezer (BMF) refrigerators in which the refrigerator compartment is formed at the upper side and the freezer compartment is formed at the lower side.

SUMMARY

Therefore, it is an aspect of the present disclosure to provide a refrigerator having an improved structure so that a storage compartment opened and closed by a single door is divided into a refrigerator compartment and a freezer compartment.

It is an aspect of the present disclosure to provide a refrigerator having an improved structure so that a freezer compartment is provided at a lower portion of a storage compartment opened and closed by a single door.

It is an aspect of the present disclosure to provide a refrigerator having an improved structure so that the leakage of cold air from a freezer compartment is prevented in a case in which a freezer compartment case provided to be slidable inside a body is closed.

Aspects of the present disclosure are not limited to those mentioned above, and other unmentioned aspects should be clearly understood by those of ordinary skill in the art to which the present disclosure pertains from the description below.

In accordance with one embodiment of the present disclosure, a refrigerator includes a body including an opening formed in a front surface, a door rotatably coupled to the body and configured to open and close the opening of the body, a refrigerator compartment provided in a first inner space of the body, and a freezer compartment case provided with a freezer compartment to insert into or withdraw from a second inner space of the body that is disposed under the first inner space, and configured to slide in a forward-backward direction between an insertion position at which the freezer compartment case is inserted into the second inner space and closes the freezer compartment and a withdrawal position at which the freezer compartment case is withdrawn from the second inner space and opens the freezer compartment, and wherein a front of the freezer compartment case is covered by the door at the insertion position in a state in which the door closes the opening of the body.

The body may further include a partition configured to partition the body into the first inner space and the second inner space so that the first inner space and the second inner space are insulated from each other. The door may cover a front of the partition while closing the opening of the body. The freezer compartment case may be provided so that, at the insertion position, a top of the freezer compartment is covered by the partition.

The freezer compartment case may further include a freezer compartment opening formed in an upper portion of the freezer compartment case and configured to open the freezer compartment. At the insertion position, the freezer compartment opening may be disposed to be spaced apart from a lower surface of the partition.

The freezer compartment case may include a front portion configured to cover a front of the freezer compartment. At the insertion position, the front portion may cover at least a portion of the partition from in front of the partition.

The freezer compartment case may further include a sealing member provided on a back surface of the front portion that faces the partition. At the insertion position, the sealing member may be configured to seal between the front portion and the partition and be fixed to the partition by a magnetic force.

The freezer compartment case may include a case insulator may be configured to insulate the first inner space from the freezer compartment at the insertion position.

The body may further include an outer case configured to form an exterior of the body and an inner case provided inside the outer case. The freezer compartment case may include a front portion configured to cover a front of the freezer compartment and a sealing member provided on a back surface of the front portion that faces the inner case and configured to seal between the inner case and the front portion at the insertion position. At the insertion position, the sealing member may be fixed to the inner case by a magnetic force.

The body may further include a body insulator foamed between the outer case and the inner case. The sealing member may include a first magnetic body. The inner case may include a second magnetic body provided on an inner surface of the inner case that faces the body insulator so that an attractive force acts between the first magnetic body and the second magnetic body due to a magnetic force.

The refrigerator may further include a cooling chamber disposed behind the second inner space; an evaporator provided in the cooling chamber and configured to generate cold air; a blower fan provided in the cooling chamber and configured to allow the cold air generated by the evaporator to flow are provided, and a communication hole configured to allow communication between the second inner space and the cooling chamber. The freezer compartment case may be configured to cover a front of the communication hole.

At the insertion position, the freezer compartment may be configured to communicate with the second inner space and the cooling chamber.

The freezer compartment case may include a cold air inlet formed so that the cold air enters from behind the freezer compartment case. The cold air inlet may be formed in an upper portion of the freezer compartment case.

The refrigerator may further include a rail provided in the second inner space and configured to support the freezer compartment case so that the freezer compartment case is slidable between the insertion position and the withdrawal position. The rail may include an inclined guide portion formed to be inclined downward toward a rear of the second inner space.

The rail may further include a horizontal guide portion disposed in front of the inclined guide portion. The horizontal guide portion may be bent from a front end of the inclined guide portion and extend in a direction parallel to a forward-backward direction of the second inner space.

The freezer compartment case may include a case insertion portion configured to insert into the rail and guided by the rail. The case insertion portion may include a case inclined portion formed to be inclined upward toward a front of the freezer compartment case.

The refrigerator may further include a closing device configured to provide an elastic force so that the freezer compartment case moves to the insertion position. The closing device may be provided in the second inner space.

The closing device may include a closing body fixed to the inner case, an elastic spring whose one end is fixed to the closing body, and a puller connected to the other end of the elastic spring and provided to be movable in the forward-backward direction relative to the closing body. In response to the freezer compartment case moving to the withdrawal position, the puller moved to a front may be locked to the closing body. In response to the freezer compartment case moving to the insertion position, the puller may be unlocked from the closing body, move to a rear, and pull the freezer compartment case toward the insertion position.

In accordance with one embodiment of the present disclosure, a refrigerator includes an outer case configured to form an exterior, an inner case configured to have a first inner space, in which a refrigerator compartment is provided, and a second inner space, which is disposed under the first inner space, provided therein, a partition disposed inside the inner case and configured to partition the inner case into the first inner space and the second inner space, a freezer compartment case provided to be slidable to insert into or withdraw from the second inner space and have a freezer compartment provided therein, and a door rotatably coupled to the outer case and configured to cover a front of the freezer compartment case and a front of the partition while closing the first inner space. The freezer compartment case may be provided so that the freezer compartment is open while the freezer compartment case is withdrawn from the second inner space and the freezer compartment is closed by the partition while the freezer compartment case is inserted into the second inner space.

The freezer compartment case may include a front portion configured to cover a front of the freezer compartment. While the freezer compartment case is inserted into the second inner space, the front portion may cover at least a portion of the partition from in front of the partition.

The freezer compartment case may further include a sealing member provided on a back of the front portion that faces the partition and configured to seal between the front portion and the partition. The sealing member may include a first magnetic body, and the partition may include a second magnetic body provided so that an attractive force acts between the first magnetic body and the second magnetic body. While the freezer compartment case is inserted into the second inner space, the sealing member may be fixed to the partition due to a magnetic force between the first magnetic body and the second magnetic body.

In accordance with one embodiment of the present disclosure, a refrigerator includes a body having an open front, a door rotatably coupled to the body to open and close the body, a storage compartment provided inside the body and including a refrigerator compartment and a freezer compartment provided under the refrigerator compartment, a cooling chamber provided inside the body and in which an evaporator configured to generate cold air and a blower fan provided to allow the generated cold air to flow to the storage compartment are disposed, and a freezer compartment case provided inside the body, provided to be slidable in a forward-backward direction to open and close the freezer compartment, and configured to communicate with the cooling chamber. The door may cover a front of the freezer compartment case while closing the body.

The refrigerator may further include a partition provided in the storage compartment and configured to vertically partition the storage compartment into the refrigerator compartment and the freezer compartment so that the refrigerator compartment and the freezer compartment are insulated from each other. The partition may cover a top of the freezer compartment while the freezer compartment is closed. The door may cover a front of the partition while closing the body.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely.

Moreover, various functions described below can be implemented or supported by one or more computer programs, each of which is formed from computer readable program code and embodied in a computer readable medium. The terms "application" and "program" refer to one or more computer programs, software components, sets of instructions, procedures, functions, objects, classes, instances, related data, or a portion thereof adapted for implementation in a suitable computer readable program code. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
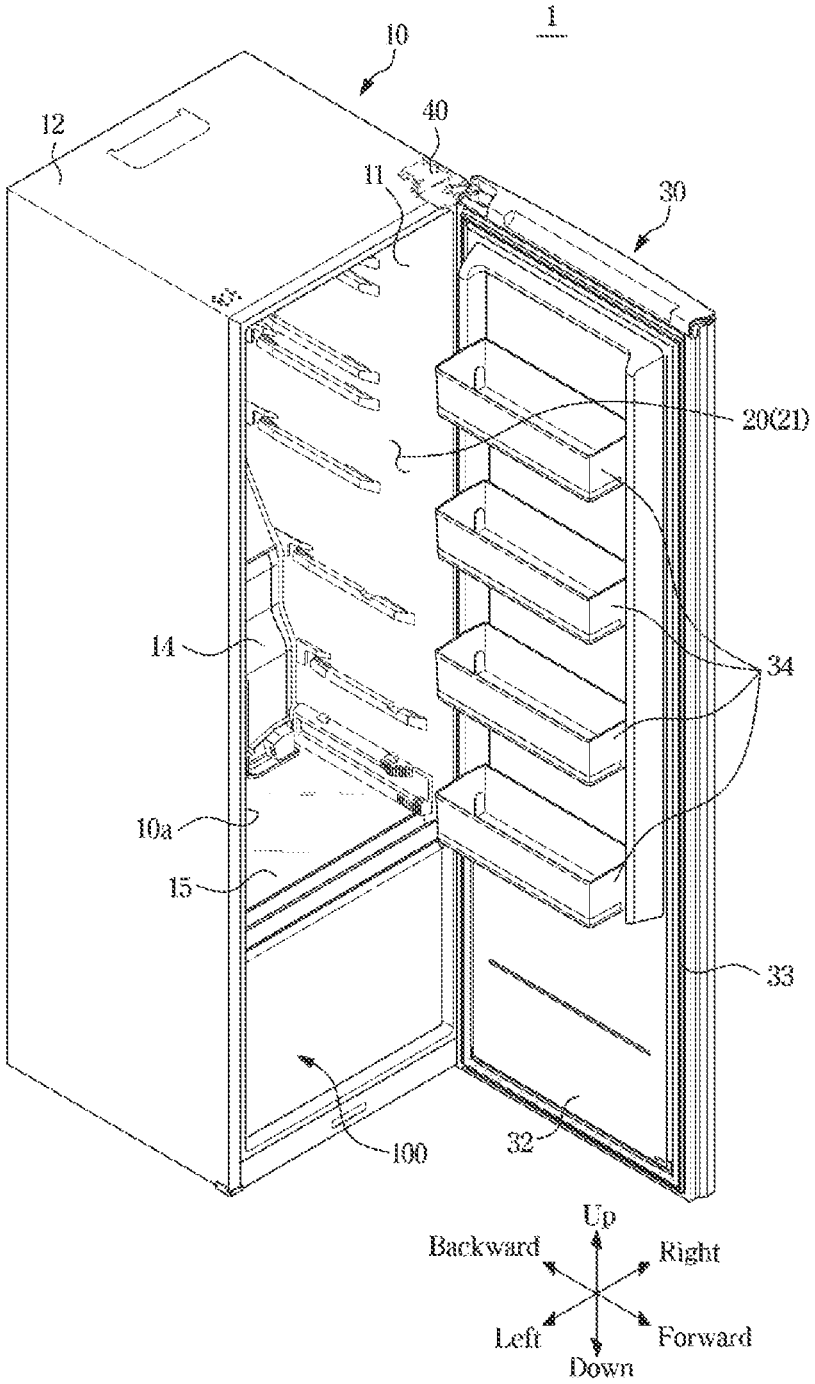
FIG. 1 is a perspective view of a refrigerator according to one embodiment of the present disclosure.

FIGS. 1 through 15, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Embodiments described herein and configurations illustrated in the drawings are merely exemplary embodiments of the present disclosure, and various modifications which may replace the embodiments and the drawings herein may be present at the time of filing this application.

Also, like reference numerals or symbols presented in the drawings of the application indicate parts or elements that perform substantially the same functions.

Also, terms used herein are for describing the embodiments and are not intended to limit and/or restrict the disclosure. A singular expression includes a plural expression unless context clearly indicates otherwise. In the application, terms such as "include" or "have" are for designating that features, numbers, steps, operations, elements, parts, or combinations thereof are present, and do not preclude the possibility of presence or addition of one or more other features, numbers, steps, operations, elements, parts, or combinations thereof in advance.

Also, terms including ordinals such as "first" and "second" used herein may be used to describe various elements, but the elements are not limited by the terms, and the terms are only used for the purpose of distinguishing one element from another element. For example, a first element may be referred to as a second element while not departing from the scope of rights of the present disclosure, and likewise, a second element may also be referred to as a first element. The term "and/or" includes a combination of a plurality of associated listed items or any one item among the plurality of associated listed items.

Meanwhile, terms such as "up-down direction," "under," and "forward-backward direction" used in the following description are defined based on the drawings, and the shape and position of each element are not limited by the terms.

Hereinafter, embodiments according to the present disclosure will be described in detail with reference to the accompanying drawings.

Figure 2:
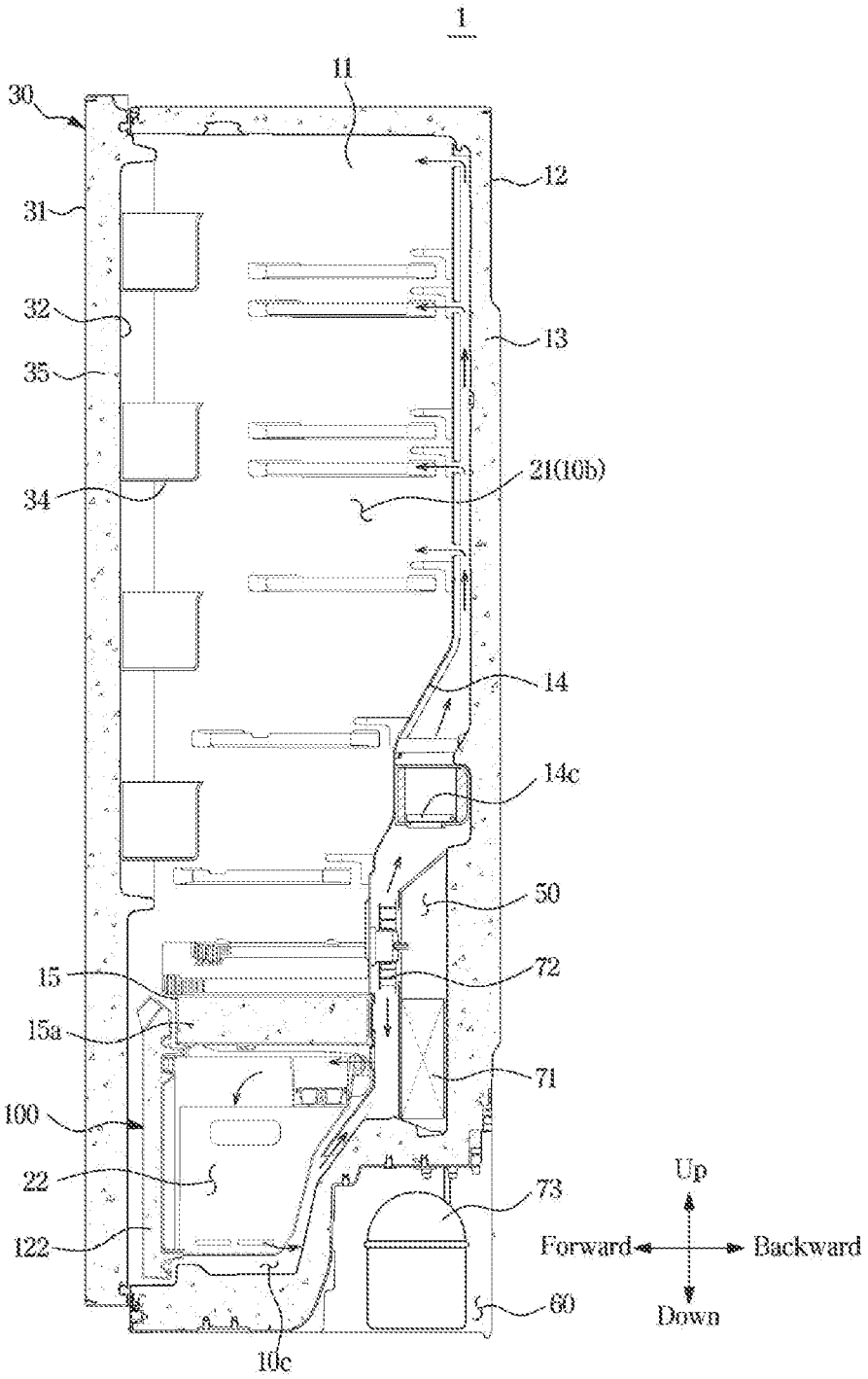
FIG. 2 is a lateral cross-sectional view of the refrigerator according to one embodiment of the present disclosure.

FIG. 1 is a perspective view of a refrigerator according to one embodiment of the present disclosure. FIG. 2 is a lateral cross-sectional view of the refrigerator according to one embodiment of the present disclosure.

Referring to FIGS. 1 and 2, a refrigerator 1 may include a body 10, a storage compartment 20 provided inside the body 10, a door 30 configured to open and close the storage compartment 20, and a cooling system configured to supply cold air to the storage compartment 20.

The body 10 may have a front surface formed to be open to allow a user to put food in the storage compartment 20 or take food out of the storage compartment 20. That is, the body 10 may include an opening 10*a* formed in the front surface of the body 10. The opening 10*a* of the body 10 may be opened and closed by the door 30.

The body 10 may include an inner case 11 configured to form the storage compartment 20, an outer case 12 configured to form an exterior of the refrigerator 1, and a body insulator 13 provided between the inner case 11 and the outer case 12.

The outer case 12 may be formed to have a substantially box-like shape having an open front surface. The outer case 12 may form upper and lower surfaces, left and right side surfaces, and a rear surface of the refrigerator 1.

The outer case 12 may include a metal material. For example, the outer case 12 may be manufactured by processing a steel sheet material.

The inner case 11 may have an open front surface. The inner case 11 may have the storage compartment 20 provided therein and may be provided inside the outer case 12. An inner wall of the inner case 11 may form an inner wall of the storage compartment 20.

The inner case 11 may include a plastic material. For example, the inner case 11 may be manufactured by a vacuum forming process. For example, the inner case 11 may be manufactured by an injection molding process.

The body insulator 13 may be provided so that the outer case 12 and the inner case 11 are insulated from each other. The body insulator 13 may couple the inner case 11 and the outer case 12 to each other by being foamed between the inner case 11 and the outer case 12. The body insulator 13 may prevent a heat exchange from occurring between the inside of the storage compartment 20 and the outside of the body 10 to improve efficiency of cooling the inside of the storage compartment 20.

Urethane foam insulation, expanded polystyrene insulation (EPS), a vacuum insulation panel, and the like may be used as the body insulator 13. However, the present disclosure is not limited thereto, and the body insulator 13 may be configured to include various other materials.

An inner space of the body 10 may include a first inner space 10*b* and a second inner space 10*c*. The second inner space 10*c* may be disposed under the first inner space 10*b*. For example, the first inner space 10*b* may be formed at an upper portion inside the body 10, and the second inner space 10*c* may be formed at a lower portion inside the body 10.

The first inner space 10*b* and the second inner space 10*c* may be formed inside the inner case 11. In other words, the first inner space 10*b* may be defined as referring to one portion of the inner space formed inside the inner case 11, and the second inner space 10*c* may be defined as referring to the other portion of the inner space formed inside the inner case 11, which is a portion provided under the first inner space 10*b*.

Cold air generated by a cold air supply device, which will be described below, may be supplied to each of the first inner space 10*b* and the second inner space 10*c*. Each of the first inner space 10*b* and the second inner space 10*c* may be provided to communicate with a cooling chamber 50. The cold air generated by the cold air supply device may flow from the cooling chamber 50 to the first inner space 10*b* and the second inner space 10*c*.

The storage compartment 20 may be formed inside the body 10. The storage compartment 20 may include a refrigerator compartment 21 maintained at a temperature of about a range from 0 to 5° C. to refrigerate and store food and a freezer compartment 22 maintained at a temperature of about a range from −30 to 0° C. to freeze and store food.

The refrigerator compartment 21 may be provided in the first inner space 10*b* of the body 10. The refrigerator compartment 21 may be provided at an upper portion of the inner space of the body 10. The refrigerator compartment 21 may be provided above the second inner space 10*c*.

Cold air introduced from the cooling chamber 50 into the first inner space 10*b* may be introduced into the refrigerator compartment 21, and the first inner space 10*b* may be maintained at a temperature suitable for refrigerating and storing food.

For example, the refrigerator compartment 21 may be a space that substantially matches the first inner space 10*b* of the body 10. Definitions of the first inner space 10*b* and the refrigerator compartment 21 may be distinguished in that the first inner space 10*b* indicates the space itself formed inside the body 10 and the refrigerator compartment 21 indicates one portion of the storage compartment 20 for storing food.

A shelf (not illustrated) on which food may be placed, a storage container (not illustrated) in which food may be stored, and the like may be provided in the refrigerator compartment 21.

The freezer compartment 22 may be provided to insert into or withdraw from the second inner space 10*c* of the body 10. More specifically, the freezer compartment 22 may be provided inside a freezer compartment case 100 which will be described below, and the freezer compartment case 100 may be provided to insert into or withdraw from the second inner space 10*c*. While the freezer compartment case 100 is inserted into the second inner space 10*c*, the freezer compartment 22 may insert thereinto and closed. While the freezer compartment case 100 is withdrawn from the second inner space 10*c*, the freezer compartment 22 may be withdrawn therefrom and open.

In other words, the freezer compartment 22 may be positioned inside the body 10 while the freezer compartment case 100 is inserted, and on the other hand, at least a portion of the freezer compartment 22 may be positioned outside the body 10 while the freezer compartment case 100 is withdrawn. However, the present disclosure is not limited thereto, and according to the size of the freezer compartment case 100, the length at which the freezer compartment case 100 can be withdrawn, or the like, the freezer compartment 22 may be positioned inside the body 10 even in a case in which the freezer compartment case 100 is withdrawn.

The freezer compartment 22 is a space provided inside the freezer compartment case 100 and is a portion of the storage compartment 20 in which food can be frozen and stored. The freezer compartment 22 may share some space with the second inner space 10*c*, but the freezer compartment 22 may be distinguished from the second inner space 10*c* in that the freezer compartment 22 is provided to insert or withdraw from the second inner space 10*c* together with the freezer compartment case 100, and is a space in which food is directly stored inside the freezer compartment case 100.

The freezer compartment 22 may be positioned in the second inner space 10*c* while the freezer compartment case 100 is inserted into the second inner space 10*c*. Cold air introduced from the cooling chamber 50 into the second inner space 10*c* may be introduced into the freezer compartment 22, and the second inner space 10*c* may be maintained at a temperature suitable for freezing and storing food.

In this way, in the refrigerator 1 according to one embodiment of the present disclosure, the refrigerator compartment 21 may be provided in the first inner space 10*b*, and the freezer compartment 22 may be provided in the second inner space 10*c* disposed under the first inner space 10*b*. In other words, the refrigerator 1 according to one embodiment of the present disclosure may be a bottom mounted freezer (BMF) refrigerator in which the refrigerator compartment 21 is formed at an upper side and the freezer compartment 22 is formed at a lower side.

The body 10 may include a partition 15 configured to partition the body 10 into the first inner space 10*b* and the second inner space 10*c*. The partition 15 may be provided between the first inner space 10*b* and the second inner space 10*c*. More specifically, the body 10 may include the partition 15 configured to vertically partition the body 10 into the first inner space 10*b* and the second inner space 10*c*.

The partition 15 may partition the body 10 into the first inner space 10*b* and the second inner space 10*c* in a direction horizontal to the ground. The partition 15 may extend in the direction horizontal to the ground or a base or bottom surface of the refrigerator 1.

An upper surface of the partition 15 may face the first inner space 10*b*. The upper surface of the partition 15 may form a lower surface of the first inner space 10*b*. The upper surface of the partition 15 may form a lower surface of the refrigerator compartment 21.

A lower surface of the partition 15 may face the second inner space 10*c*. The lower surface of the partition 15 may form an upper surface of the second inner space 10*c*. The lower surface of the partition 15 may cover a top of the freezer compartment 22 while the freezer compartment case 100 is inserted into the second inner space 10*c*. The lower surface of the partition 15 may form an upper surface of the freezer compartment 22 while the freezer compartment case 100 is inserted into the second inner space 10*c*.

The partition 15 may be disposed inside the inner case 11. The partition 15 may be coupled to the inner wall of the inner case 11. Specifically, the inner case 11 may include a partition coupling portion 11*b* (see FIG. 3) formed on the inner wall of the inner case 11, and the partition 15 may be coupled to the partition coupling portion 11*b*. For example, the partition coupling portion 11*b* may be formed to have the shape of a groove concavely recessed in the inner wall of the inner case 11. The partition 15 may insert into the groove of the partition coupling portion 11*b* and coupled thereto.

Based on FIG. 1, the partition coupling portion 11*b* may be formed on a left side surface or a right side surface of the inner case 11.

However, the present disclosure is not limited thereto, and the partition 15 may be configured in various other ways in order to be disposed inside the inner case 11. For example, the partition 15 may be adhered using an adhesive or the like or may be coupled to the inner case 11 using a fastening member such as a screw. For example, the partition 15 may be integrally formed with the inner case 11.

As described above, the refrigerator compartment 21 may be provided in the first inner space 10*b*, and the freezer compartment 22 may be provided in the second inner space 10*c*. Accordingly, it is necessary to maintain the first inner space 10*b* and the second inner space 10*c* at different temperatures.

The partition 15 may partition the body 10 into the first inner space 10*b* and the second inner space 10*c* so that the first inner space 10*b* and the second inner space 10*c* are insulated from each other. The partition 15 may be provided so that the refrigerator compartment 21 and the freezer compartment 22 are insulated from each other while the freezer compartment case 100 is inserted.

For example, the partition 15 may include a partition insulator 15*a* provided inside the partition 15. The partition insulator 15*a* may be formed to be foamed between an upper surface and a lower surface of the partition 15.

The partition insulator 15*a* may be provided to prevent a heat exchange from occurring between the first inner space 10*b* and the second inner space 10*c* and maintain the refrigerator compartment 21 and the freezer compartment 22 at different temperatures.

Urethane foam insulation, expanded polystyrene insulation (EPS), a vacuum insulation panel, and the like may be used as the partition insulator 15*a*. However, the present disclosure is not limited thereto, and the partition insulator 15*a* may be configured to include various other materials.

For example, the partition insulator 15*a* may be configured with an insulator made of the same material as the body insulator 13. On the other hand, for example, the partition insulator 15*a* may be configured with an insulator made of a different material from the body insulator 13.

For example, the partition 15 may be manufactured by a method in which the partition insulator 15*a* is foamed inside the partition 15 first in a manufacturing step, and then the partition 15 is coupled to the inner case 11. Alternatively, for example, the partition 15 may be manufactured by a method in which the partition 15 is coupled to the inner case 11 first in a state before the partition insulator 15*a* is foamed, and then the partition insulator 15*a* is foamed simultaneously with the body insulator 13. Methods of manufacturing the partition 15 are not limited thereto, and the partition 15 may be manufactured using various other methods.

The refrigerator 1 may include a cooling system provided to generate cold air using a cooling cycle and supply the generated cold air to the first inner space 10*b* and the second inner space 10*c*.

The cooling system may generate cold air using evaporative latent heat of a refrigerant in the cooling cycle. The cooling system may be configured to include a compressor 73, a condenser (not illustrated), an expansion valve (not illustrated), an evaporator 71, a blower fan 72, and the like.

The cooling system may be provided in a cooling chamber 50 and a mechanical chamber 60 provided in the body 10. For example, the cooling chamber 50 may house the evaporator 71 configured to generate cold air and the blower fan 72 provided to allow the cold air generated by the evaporator 71 to flow. The mechanical chamber may house the compressor 73 and the condenser.

The cooling chamber 50 may be disposed behind the first inner space 10*b*. The cooling chamber 50 may be disposed behind the second inner space 10*c*.

The mechanical chamber 60 may be disposed behind the first inner space 10*b*. The mechanical chamber 60 may be disposed behind the second inner space 10*c*.

Components of the refrigerator 1 that constitute the cooling system may have a relatively large weight. Accordingly, the cooling chamber 50 and the mechanical chamber 60 may be provided at a lower portion of the body 10. However, the present disclosure is not limited thereto, and the cooling chamber 50 and the mechanical chamber 60 may be disposed in various other ways, and the components constituting the cooling system may be disposed in various ways to correspond to the positions of the cooling chamber 50 and the mechanical chamber 60.

Since cold air is generated by the evaporator 71 in the cooling chamber 50, the cooling chamber 50 may maintain a relatively low-temperature state. On the other hand, since heat is generated by the compressor 73, the condenser, and the like in the mechanical chamber 60, the mechanical chamber 60 may maintain a relatively high-temperature state. Accordingly, the cooling chamber 50 and the mechanical chamber 60 may be formed in separate spaces and insulated from each other. For example, the body insulator 13 may be foamed between the cooling chamber 50 and the mechanical chamber 60.

As illustrated in FIG. 2, the evaporator 71 provided in the cooling chamber 50 may evaporate a refrigerant to generate cold air, and the cold air generated by the evaporator 71 may flow due to the blower fan 72. Some of the cold air flowing due to the blower fan 72 may be supplied into the first inner space 10*b*, and the rest of the cold air flowing due to the blower fan 72 may be supplied into the second inner space 10*c*. In other words, the evaporator 71 may generate cold air in the cooling chamber 50, and the cold air generated by the evaporator 71 may flow from the cooling chamber 50 to the storage compartment 20 due to the blower fan 72 provided in the cooling chamber 50. The cooling chamber 50 may be provided to communicate with each of the first inner space 10*b* and the second inner space 10*c*.

In other words, as illustrated in FIG. 2, the refrigerator 1 according to one embodiment of the present disclosure may be an indirect-cooling refrigerator. Hereinafter, for convenience of description, description will be given assuming that the refrigerator 1 according to one embodiment of the present disclosure is an indirect-cooling refrigerator, but the spirit of the present disclosure is not limited thereto and may also apply to a direct-cooling refrigerator.

The evaporator 71, the blower fan 72, and other devices disposed in the cooling chamber 50 may be referred to as cold air supply devices in that the evaporator 71 generates cold air and the blower fan 72 supplies the cold air to the storage compartment 20.

The body 10 may include a cold air supply duct 14. The cold air supply duct 14 may form a flow path along which the cold air generated by the cold air supply device flows from the cooling chamber 50 to the first inner space 10*b* or the second inner space 10*c*. Each of the first inner space 10*b* and the second inner space 10*c* may be provided to communicate with the cold air supply duct 14.

The cold air supply duct 14 may be formed inside the inner case 11. The cold air supply duct 14 may be formed at a rear portion of the inner case 11. More specifically, the cold air supply duct 14 may be provided behind the storage compartment 20.

For example, only a single evaporator 71 may be provided in the cooling chamber 50. The blower fan 72 may be provided so that cold air generated by the single evaporator 71 flows to each of the first inner space 10*b* and the second inner space 10*c*. In such a case, the cold air generated by the single evaporator 71 may have temperatures in a certain range. Accordingly, in order to maintain different temperatures of the first inner space 10*b* and the second inner space 10*c*, the amount of cold air introduced into the first inner space 10*b* may be different from the amount of cold air introduced into the second inner space 10*c*. For example, a damper 14*c* provided to control the amount of cold air heading toward the first inner space 10*b* may be provided in the cold air supply duct 14. The damper 14*c* may be provided to open and close the flow path of cold air heading toward the first inner space 10*b* from the cooling chamber 50. A refrigerator compartment temperature sensor (not illustrated) provided to measure the temperature of the refrigerator compartment 21 may be provided in the refrigerator compartment 21, and a controller (not illustrated) of the refrigerator 1 may receive an output value of the refrigerator compartment temperature sensor and control the opening and closing of the damper 14*c*.

However, the present disclosure is not limited thereto, and a configuration that maintains the temperatures of the first inner space 10*b* and the second inner space 10*c* to be different from each other may be provided in various other ways. For example, two or more evaporators (not illustrated) may be provided in the cooling chamber 50. At least one evaporator may be provided to generate cold air supplied to the first inner space 10*b*, and at least another evaporator may be provided to generate cold air supplied to the second inner space 10*c*. Corresponding to each of the evaporators, two or more blower fans (not illustrated) may be provided in the cooling chamber 50. Here, an evaporator and a blower fan for supplying cold air to the first inner space 10*b* and an evaporator and a blower fan for supplying cold air to the second inner space 10*c* may be disposed in separate spaces in the cooling chamber 50.

The door 30 may be provided to open and close the body 10. The door 30 may be rotatably coupled to the body 10. More specifically, the door 30 may be rotatably coupled to the body 10 by a hinge 40 connected to each of the door 30 and the body 10. The door 30 may be rotatably coupled to the outer case 12.

An outer surface 31 of the door 30 may form a portion of the exterior of the refrigerator 1. While the door 30 is at a closing position, the outer surface 31 of the door 30 may form a front surface of the door 30.

An inner surface 32 of the door 30 may be formed at a side opposite to the outer surface 31 of the door 30. While the door 30 is at the closing position, the inner surface 32 of the door 30 may form a rear surface of the door 30. While the door 30 is at the closing position, the inner surface 32 of the door 30 may be provided to face the inside of the body 10. While the door 30 is at the closing position, the inner surface 32 of the door 30 may be provided to cover the front of the first inner space 10*b* and the front of the second inner space 10*c*.

A foaming space may be formed between the outer surface 31 of the door 30 and the inner surface 32 of the door 30, and a door insulator 35 may be foamed in the foaming space. The door insulator 35 may prevent a heat exchange from occurring between the outer surface 31 of the door 30 and the inner surface 32 of the door 30. The door insulator 35 may improve insulation performance between the inside of the storage compartment 20 and the outside of the door 30.

Urethane foam insulation, expanded polystyrene insulation (EPS), a vacuum insulation panel, and the like may be used as the door insulator 35. However, the present disclosure is not limited thereto, and the door insulator 35 may be configured to include various other materials.

For example, the door insulator 35 may be configured with an insulator made of the same material as the body insulator 13 or the partition insulator 15*a*. On the other hand, for example, the door insulator 35 may be configured with an insulator made of a different material from the body insulator 13 or the partition insulator 15*a*.

A door gasket 33 provided to seal a gap between the door 30 and the body 10 and prevent leakage of cold air from the storage compartment 20 may be provided on the inner surface 32 of the door 30. The door gasket 33 may be provided along the periphery of the inner surface 32 of the door 30. The door gasket 33 may be disposed to be parallel to the opening 10*a* of the body 10 while the door 30 is closed. The door gasket 33 may be configured to include an elastic material such as rubber.

A door shelf 34 on which food may be stored may be provided on the inner surface 32 of the door 30.

The door 30 may be provided as a single door and may be rotatably coupled to the body 10 and open and close the body 10. In other words, the single door 30 may be provided to open and close the inner space of the body 10 as a whole.

The door 30 may close the first inner space 10*b* while closing the opening 10*a* of the body 10. The door 30 may cover the front of the first inner space 10*b* while closing the opening 10*a* of the body 10.

The door 30 may cover the front of the freezer compartment case 100, which will be described below, while closing the opening 10*a* of the body 10. In other words, while the door 30 is closed, the front of the freezer compartment case 100 may be closed by the door 30 in a state in which the freezer compartment case 100 is inserted into the second inner space 10*c*. When closing the opening 10*a* of the body 10, the door 30 may, instead of directly closing the second inner space 10*c*, cover the front of the freezer compartment case 100 closing the second inner space 10*c* and cover the front of the second inner space 10*c*.

The door 30 may cover the front of the partition 15 while closing the opening 10*a* of the body 10. That is, the entire partition 15 may be disposed inside the body 10, and in the state in which the opening 10*a* of the body 10 is closed, the partition 15 may be covered by the door 30 and not be exposed to the exterior.

The configuration of the refrigerator 1 described above with reference to FIGS. 1 and 2 is only an example for describing a refrigerator according to the spirit of the present disclosure, and the spirit of the present disclosure is not limited thereto. The refrigerator according to the spirit of the present disclosure may be provided to include various configurations for performing a function of supplying cold air to a refrigerator compartment and a freezer compartment for storing food.

Figure 3:
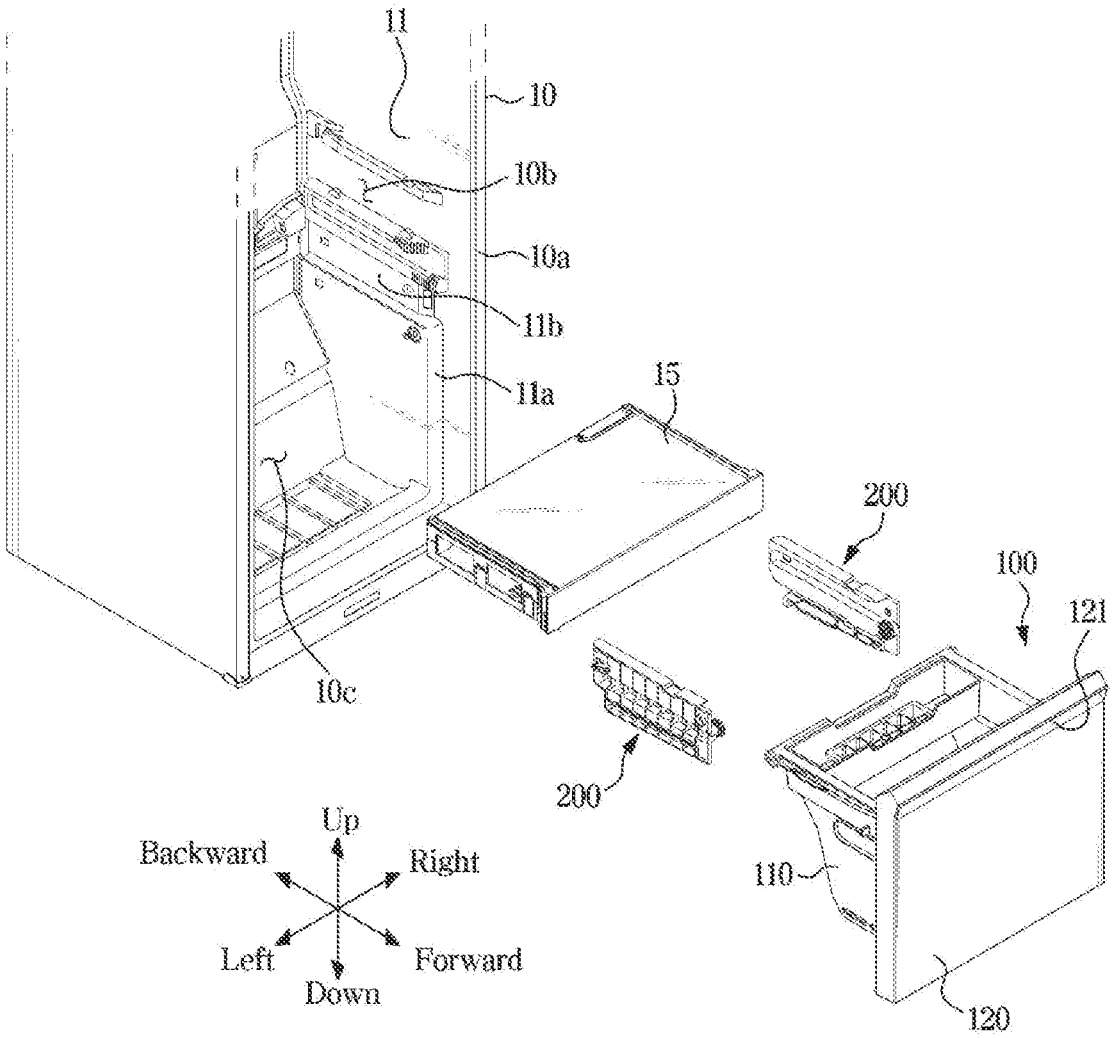
FIG. 3 is an exploded view of a partial configuration of the refrigerator according to one embodiment of the present disclosure.
Figure 4:
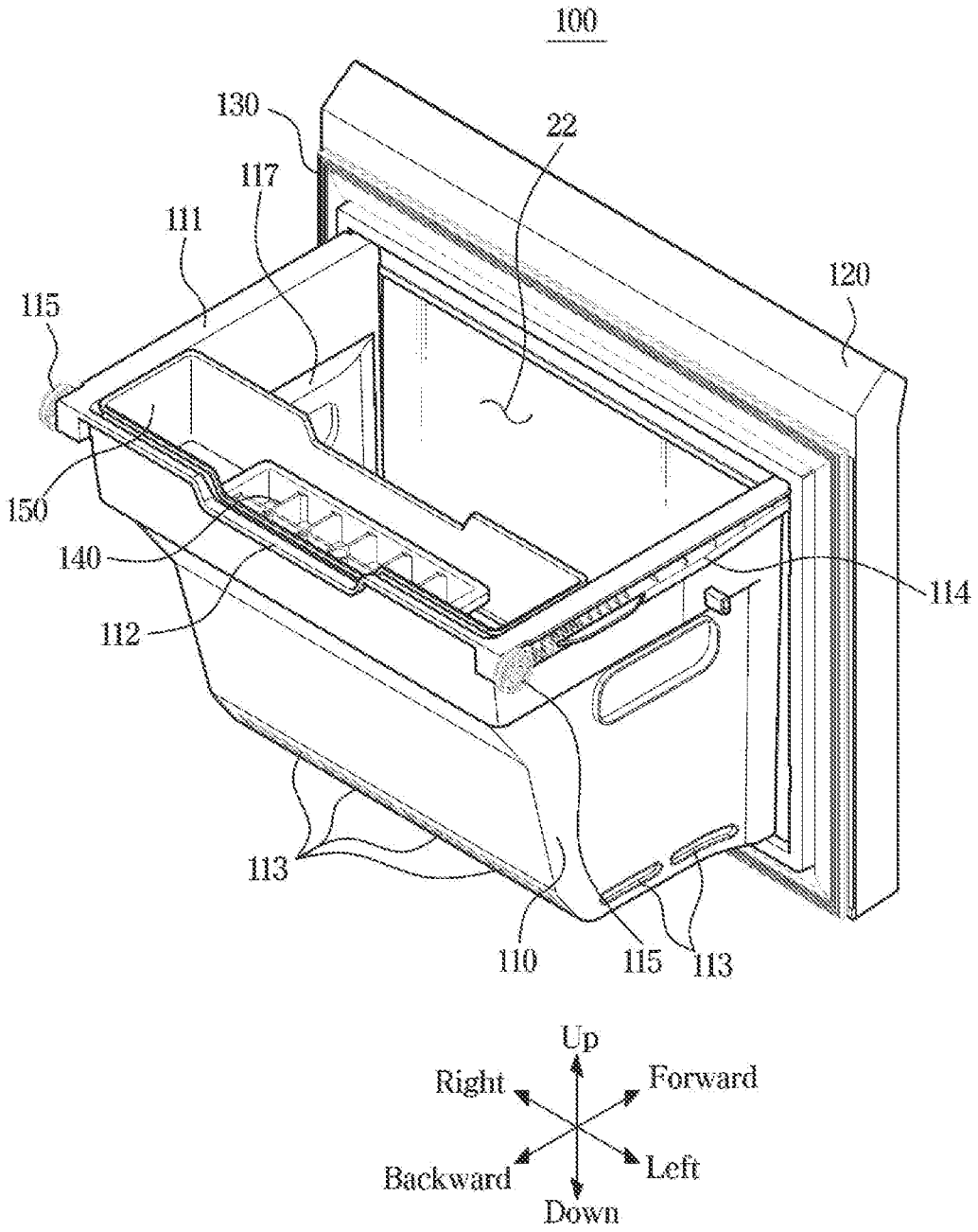
FIG. 4 is a rear perspective view illustrating a freezer compartment case of the refrigerator according to one embodiment of the present disclosure.
Figure 5:
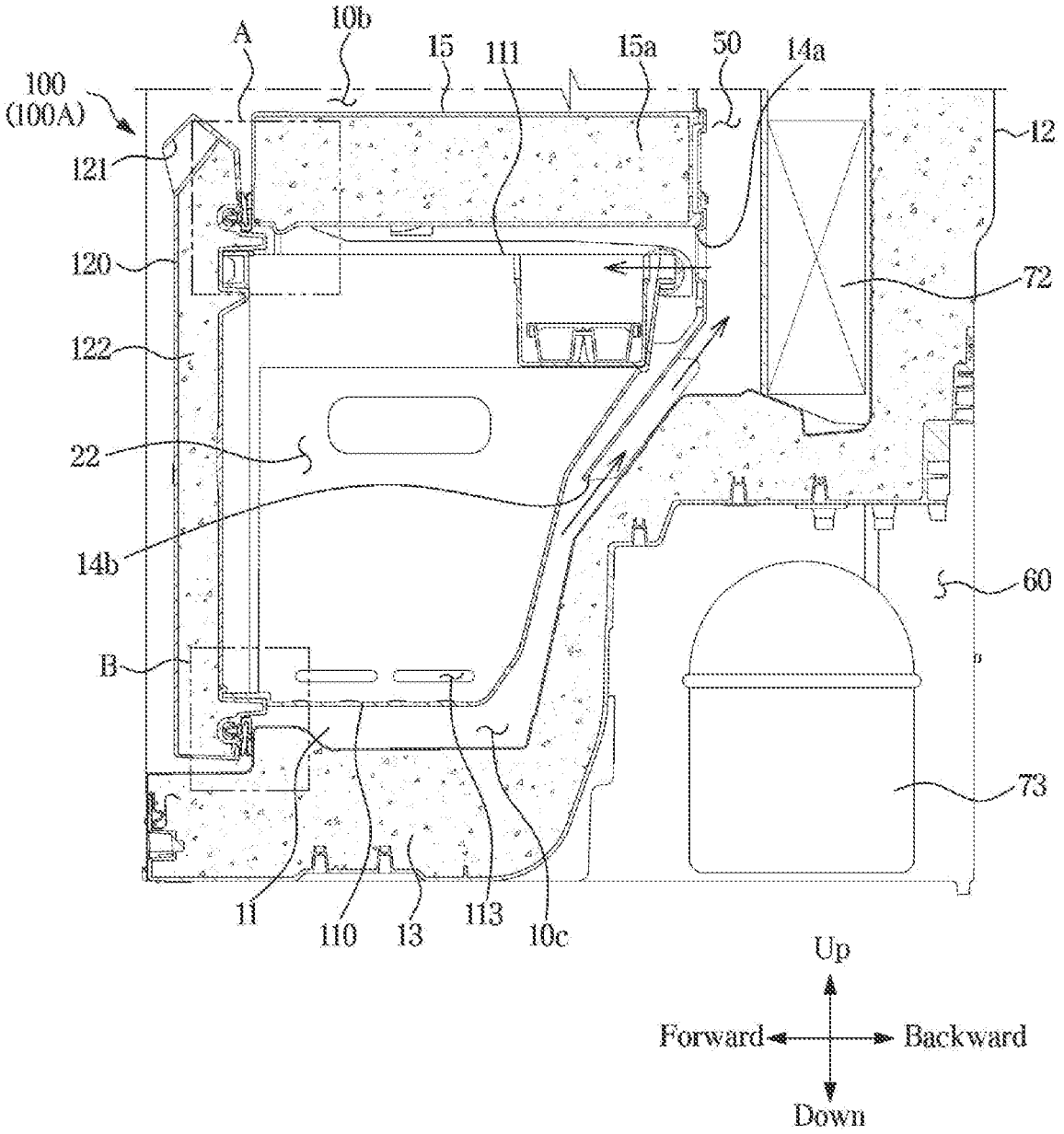
FIG. 5 is an enlarged cross-sectional view of a partial configuration of the refrigerator according to one embodiment of the present disclosure.
Figure 6:
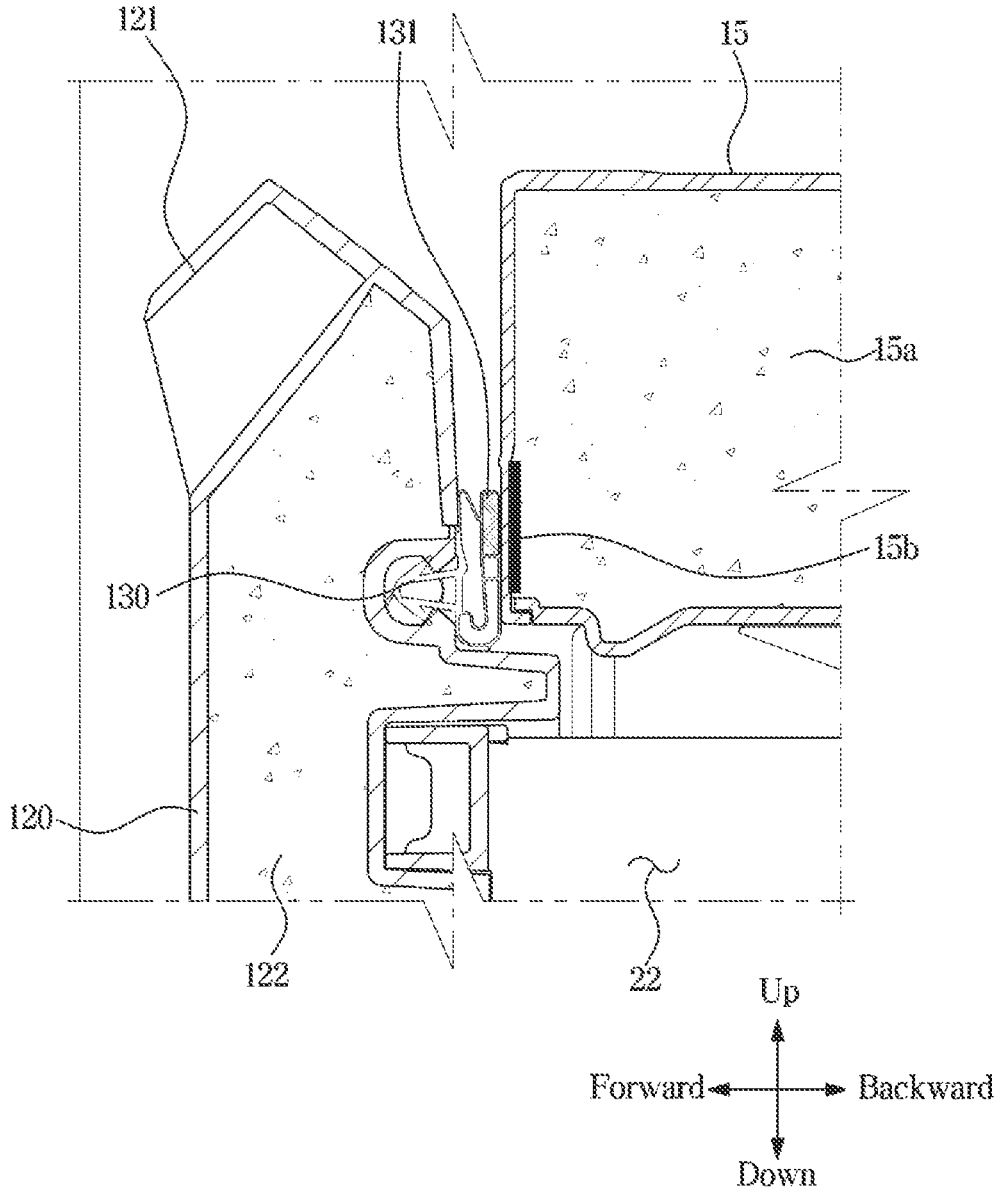
FIG. 6 is an enlarged view of A of FIG. 5.
Figure 7:
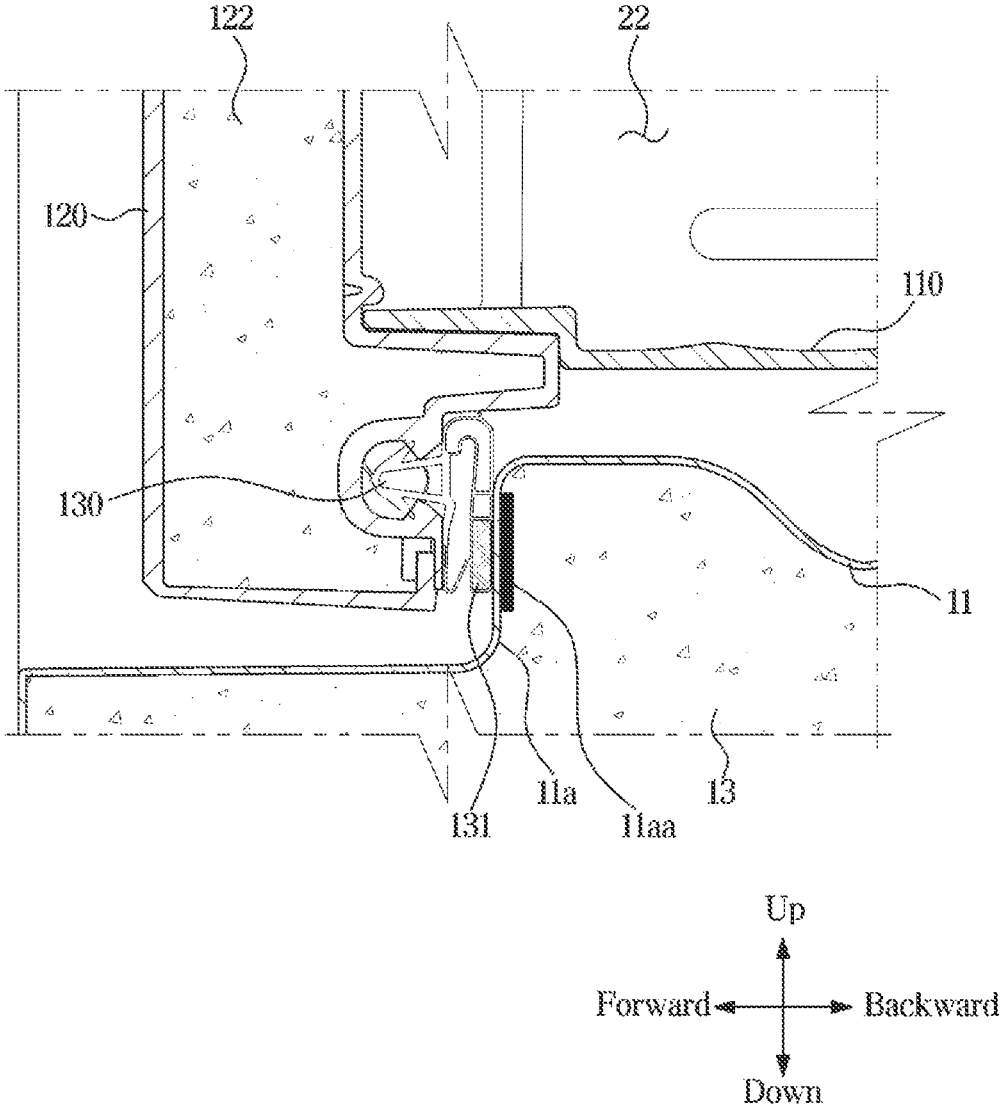
FIG. 7 is an enlarged view of B of FIG. 5.
Figure 8:
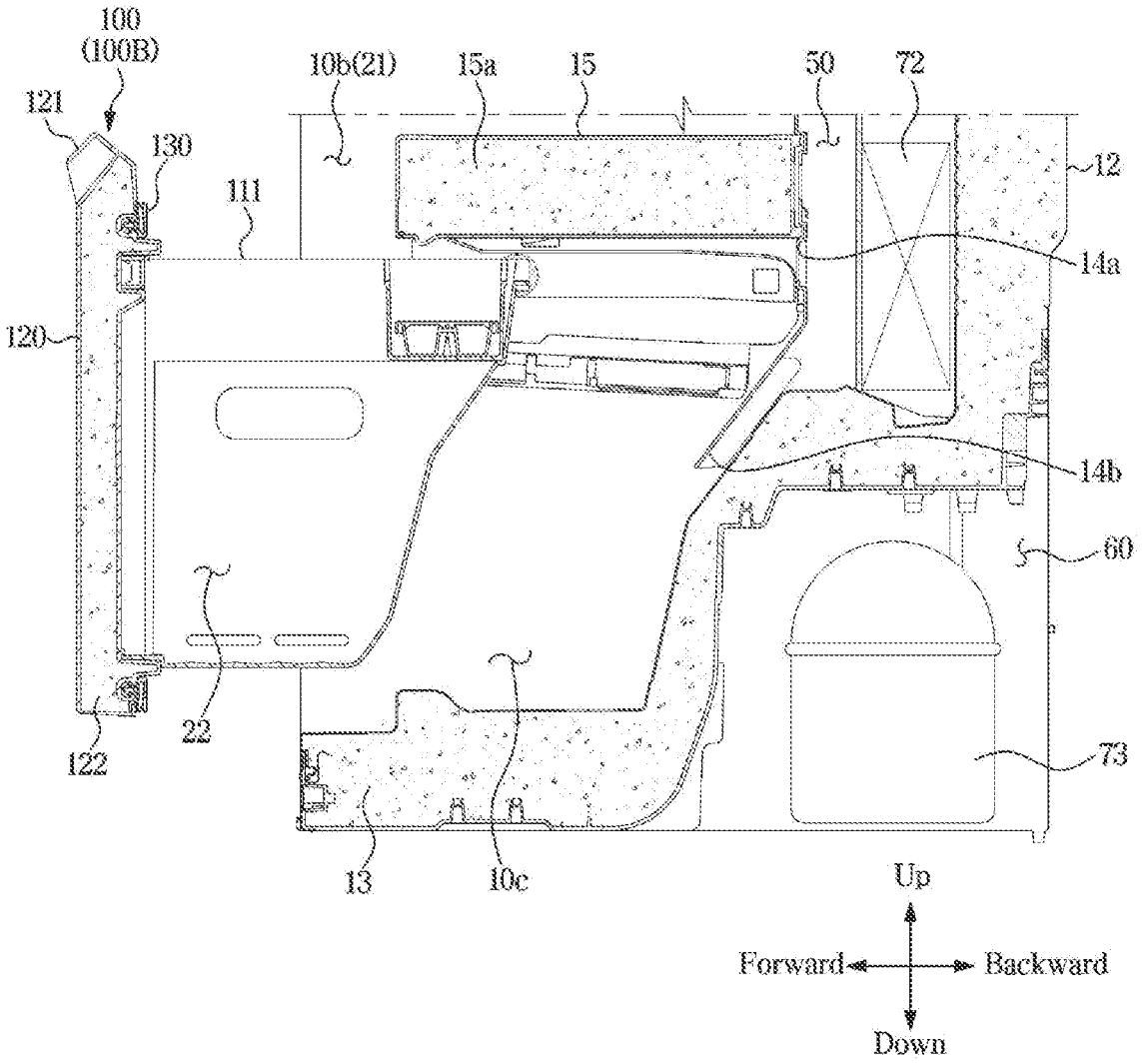
FIG. 8 is an enlarged cross-sectional view of a state in which the freezer compartment case is withdrawn from the refrigerator according to one embodiment of the present disclosure.

FIG. 3 is an exploded view of a partial configuration of the refrigerator according to one embodiment of the present disclosure. FIG. 4 is a rear perspective view illustrating a freezer compartment case of the refrigerator according to one embodiment of the present disclosure. FIG. 5 is an enlarged cross-sectional view of a partial configuration of the refrigerator according to one embodiment of the present disclosure. FIG. 6 is an enlarged view of A of FIG. 5. FIG. 7 is an enlarged view of B of FIG. 5. FIG. 8 is an enlarged cross-sectional view of a state in which the freezer compartment case is withdrawn from the refrigerator according to one embodiment of the present disclosure.

Referring to FIGS. 3 to 8, the refrigerator 1 may include the freezer compartment case 100 in which the freezer compartment 22 is provided. The freezer compartment case 100 may be provided to open and close the freezer compartment 22. The freezer compartment 22 may be defined as a space formed inside the freezer compartment case 100.

The freezer compartment case 100 may be provided inside the body 10. More specifically, the freezer compartment case 100 may be provided inside the inner case 11.

The freezer compartment case 100 may be provided in the second inner space 10*c* of the body 10. The freezer compartment case 100 may be provided at a lower portion of the body 10. Corresponding thereto, the freezer compartment 22 may also be provided in the second inner space 10*c* of the body 10. The freezer compartment 22 may be provided at the lower portion of the body 10.

The freezer compartment case 100 may be provided to insert into or withdraw from the second inner space 10*c*. The freezer compartment 22 may be provided to insert into or withdraw from the second inner space 10*c* together with the freezer compartment case 100. When the freezer compartment case 100 is withdrawn from the second inner space 10*c*, the freezer compartment 22 may be withdrawn from the second inner space 10*c*. When the freezer compartment case 100 is inserted into the second inner space 10*c*, the freezer compartment 22 may insert into the second inner space 10*c*.

A position at which the freezer compartment case 100 is inserted into the second inner space 10*c* may be referred to as an insertion position 100A, and a position at which the freezer compartment case 100 is withdrawn from the second inner space 10*c* may be referred to as a withdrawal position 100B. The freezer compartment case 100 may be provided to be movable between the insertion position 100A and the withdrawal position 100B.

Further, for convenience of description, each configuration constituting the freezer compartment case 100 (a case body 110, a front portion 120, a sealing member 130, or the like) may also be referred to as being positioned at the insertion position 100A or the withdrawal position 100B and may be referred to as being provided to be movable between the insertion position 100A and the withdrawal position 100B. Likewise, the freezer compartment 22 provided in the freezer compartment case 100 may also be referred to as being positioned at the insertion position 100A or the withdrawal position 100B and may be referred to as being provided to be movable between the insertion position 100A and the withdrawal position 100B.

The freezer compartment case 100 may be provided to be slidable relative to the second inner space 10*c*. That is, the freezer compartment case 100 may be provided to be slidable in a forward-backward direction between the insertion position 100A and the withdrawal position 100B.

Specifically, the refrigerator 1 may further include a rail 200 configured to support the freezer compartment case 100 so that the freezer compartment case 100 is slidable between the insertion position 100A and the withdrawal position 100B.

The rail 200 may be provided in the second inner space 10*c*. The freezer compartment case 100 may be provided to be slidable along the rail 200 and provided to insert into or withdraw from the second inner space 10*c*.

The rail 200 may be provided on the inner wall of the inner case 11. For example, based on FIG. 3, the rail 200 may be provided on each of a left-side inner wall and a right-side inner wall of the inner case 11.

For example, the rail 200 may be mounted on the inner case 11. The rail 200 may be mounted on an inner wall of the second inner space 10*c*. Based on FIG. 3, the rail may be mounted on each of the left-side inner wall and the right-side inner wall of the inner case 11.

On the other hand, for example, the rail 200 may be integrally formed with the inner wall of the inner case 11 instead of being separately formed and mounted on the inner case 11.

Detailed description of the configuration of the rail 200 will be given below.

The freezer compartment case 100 may cover the front of the second inner space 10*c*. The freezer compartment case 100 may, while covering the front of the second inner space 10*c*, move in the forward-backward direction between the insertion position 100A and the withdrawal position 100B.

At the insertion position 100A, the freezer compartment case 100 may close the front of the second inner space 10*c*. At the insertion position 100A, the freezer compartment case 100 may be provided so that the inside of the second inner space 10*c* is isolated from the outside and may prevent cold air of the second inner space 10*c* from leaking to the outside.

The freezer compartment case 100 may include a freezer compartment opening 111 configured to open the freezer compartment 22. The freezer compartment opening 111 may be formed at an upper portion of the freezer compartment case 100. The freezer compartment opening 111 may be formed so that the freezer compartment 22 is open in an up-down direction.

The freezer compartment 22 may be closed at the insertion position 100A. The freezer compartment 22 may be open at the withdrawal position 100B. The freezer compartment opening 111 may be closed at the insertion position 100A and open at the withdrawal position 100B.

For example, the freezer compartment 22 may be opened and closed by the partition 15. The freezer compartment case 100 may be provided so that the freezer compartment 22 is closed by the partition 15 at the insertion position 100A. More specifically, the top of the freezer compartment 22 may be covered by the partition 15 at the insertion position 100A. At the withdrawal position 100B, the freezer compartment 22 may be positioned in front of the partition 15, and the top of the freezer compartment 22 may be open.

In other words, the freezer compartment case 100 may be provided so that the top of the freezer compartment 22 is covered by the partition 15 at the insertion position 100A. The freezer compartment case 100 may be provided so that the top of the freezer compartment opening 111 is covered by the partition 15 at the insertion position 100A.

However, the present disclosure is not limited thereto, and for example, the freezer compartment 22 may be provided so that a configuration other than the partition 15 opens and closes the freezer compartment 22 and covers the top of the freezer compartment 22 at the insertion position 100A. However, hereinafter, for convenience of description, description will be given assuming that the freezer compartment 22 is opened and closed by the partition 15, and the top of the freezer compartment 22 is covered by the partition 15 at the insertion position 100A.

The freezer compartment case 100 may be provided in the inner space of the body 10. The freezer compartment case 100 may be positioned inside the body 10 while at the insertion position 100A and may have at least a portion positioned outside the body 10 while at the withdrawal position 100B. The freezer compartment case 100 may move through the opening 10*a* of the body 10 when moving from the insertion position 100A to the withdrawal position 100B.

The freezer compartment case 100 may have the front covered by the door 30 while the door 30 closes the opening 10*a* of the body 10. The freezer compartment case 100 may be positioned at the insertion position 100A while the door 30 is closed and may have the front covered by the door 30 at the insertion position 100A. The door 30 may be provided to, while closed, cover the front portion 120 of the freezer compartment case 100 which will be described below.

In other words, the door 30 may cover the front of the freezer compartment case 100 while closing the first inner space 10*b*.

Also, the door 30 may cover the front of the partition 15 while closing the opening 10*a* of the body 10. The door 30 may simultaneously cover the front of the partition 15 and the front of the freezer compartment case 100 while closing the first inner space 10*b*.

By such a configuration, the exterior of the refrigerator 1 may be formed by the outer case 12 and the door 30 while the door 30 is closed. In particular, the exterior of the front of the refrigerator 1 may be formed mostly by the outer surface 31 of the door 30. While the door 30 is closed, the partition 15 and the freezer compartment case 100 are positioned inside the body 10 and covered by the door 30 and do not form the exterior of the refrigerator 1.

In other words, the exterior of the front of the refrigerator 1 according to one embodiment of the present disclosure may be formed by the single door 30 configured to open and close the opening 10*a* of the body 10. As compared to a refrigerator 1 opened and closed by a plurality of doors 30, the refrigerator 1 opened and closed by the single door 30 may provide an exterior that makes a user feel a different aesthetic sense.

In the refrigerator 1 in which the storage compartment 20 is opened and closed by the single door 30, as the freezer compartment 22 is provided inside the freezer compartment case 100, the refrigerator compartment 21 and the freezer compartment 22 may be isolated from each other.

The freezer compartment case 100 may be provided to insert into or withdraw from the second inner space 10*c* positioned at a lower portion of the body 10, and thus it may be easy for the user to access the freezer compartment 22.

Also, since the freezer compartment case 100 is able to slide relative to the second inner space 10*c* positioned at the lower portion of the body 10, and the top of the freezer compartment 22 is open at the withdrawal position 100B, the degree of leakage of cold air from the freezer compartment 22 may be reduced.

The freezer compartment case 100 may include the case body 110 in which the freezer compartment 22 is provided and the front portion 120 configured to form a front surface of the freezer compartment case 100.

As illustrated in FIG. 3 or the like, the case body 110 may substantially have the shape of a basket formed to store food. The shape of the case body 110 is not limited to the shape illustrated in FIG. 3, and the case body 110 may be formed to have various other shapes that allow the freezer compartment 22 to be provided in the case body 110.

The case body 110 may include the freezer compartment opening 111 described above. The freezer compartment opening 111 may be provided at an upper portion of the case body 110. That is, the case body 110 may include a shape having an open upper portion.

The front portion 120 may be provided in front of the case body 110. The front portion 120 may be provided in front of the freezer compartment 22. The front portion 120 may cover the front of the freezer compartment 22.

The front portion 120 may be formed to include the shape of a substantially flat plate. However, the present disclosure is not limited thereto, and the front portion 120 may be formed to have various other shapes.

The front portion 120 may include a grip portion 121 formed to be gripped by the user. The user may move the freezer compartment case 100 to the withdrawal position 100B using the grip portion 121.

At the insertion position 100A, the front portion 120 may not only cover the front of the freezer compartment 22 but also cover the front of the second inner space 10*c*. More specifically, the front portion 120 may close the front of the second inner space 10*c* at the insertion position 100A.

The inner case 11 may include a front support portion 11*a* provided so that the front portion 120 is supported at the insertion position 100A. While the freezer compartment case 100 is at the insertion position 100A, the front portion 120 may be positioned closest to the front support portion 11*a*.

The front support portion 11*a* may be provided to be adjacent to a front portion of the second inner space 10*c*. The front support portion 11*a* may be formed along a periphery of an opening of the front portion of the second inner space 10*c* that is open in the forward-backward direction.

The front portion 120 may cover a front of the front support portion 11*a* at the insertion position 100A. While moving from the insertion position 100A to the withdrawal position 100B, the front portion 120 may move to the front of the front support portion 11*a* and move away from the front support portion 11*a*.

As compared to a case in which the front portion 120 simply covers the front of the second inner space 10*c* at the insertion position 100A, in a case in which the front portion 120 covers the front of the front support portion 11*a* at the insertion position 100A, the front portion 120 may more efficiently seal the second inner space 10*c* and the freezer compartment 22 and efficiently prevent leakage of cold air from the second inner space 10*c* and the freezer compartment 22.

At the insertion position 100A, the front portion 120 may cover at least a portion of the partition 15 from in front of the partition 15. In such a case, the front portion 120 may more efficiently seal the second inner space 10*c* and the freezer compartment 22 and efficiently prevent leakage of cold air from the freezer compartment 22 through a gap between the partition 15 and the freezer compartment case 100. In particular, for example, as will be described below, the freezer compartment opening 111 of the case body 110 may be spaced apart from the lower surface of the partition 15 at the insertion position 100A, and here, as the front portion 120 covers at least a portion of the partition 15 from in front of the partition 15, leakage of cold air to the outside through a separation space between the freezer compartment opening 111 and the partition 15 may be prevented.

The freezer compartment case 100 may include a case insulator 122. The case insulator 122 may be provided so that the first inner space 10*b* and the freezer compartment 22 are insulated from each other at the insertion position 100A.

The case insulator 122 may be provided in front of the freezer compartment 22. More specifically, the case insulator 122 may be provided in the front portion 120 of the freezer compartment case 100.

The case insulator 122 may prevent a heat exchange from occurring between the first inner space 10*b* and the freezer compartment 22. Further, the case insulator 122 may prevent a heat exchange from occurring between the first inner space 10*b* and the second inner space 10*c*. The case insulator 122 may improve insulation performance between the inside and outside of the freezer compartment case 100 while the freezer compartment case 100 is at the insertion position 100A and may be provided so that the refrigerator compartment 21 and the freezer compartment 22 efficiently maintain different temperatures.

For example, the case insulator 122 may be foamed inside the front portion 120. A foaming space may be formed between a front surface and a back surface of the front portion 120, and the case insulator 122 may be foamed in the foaming space.

Urethane foam insulation, expanded polystyrene insulation (EPS), a vacuum insulation panel, and the like may be used as the case insulator 122. However, the present disclosure is not limited thereto, and the case insulator 122 may be configured to include various other materials.

For example, the case insulator 122 may be configured with an insulator made of the same material as the body insulator 13, the partition insulator 15*a*, or the door insulator 35. On the other hand, for example, the case insulator 122 may be configured with an insulator made of a different material from the body insulator 13 or the partition insulator 15*a* or the door insulator 35.

The freezer compartment case 100 may further include the sealing member 130 provided to, at the insertion position 100A, seal between the front portion 120 and the partition 15 or between the front portion 120 and the inner case 11.

The sealing member 130 may be provided on the back surface of the front portion 120. The sealing member 130 may be provided along the periphery of the back surface of the front portion 120. The sealing member 130 may be formed to have the shape of a substantially closed loop.

The back surface of the front portion 120 may face the inner case 11. More specifically, the back surface of the front portion 120 may face the front support portion 11*a* of the inner case 11. The sealing member 130 may be provided to seal a gap between the back surface of the front portion 120 and the front support portion 11*a* at the insertion position 100A.

The back surface of the front portion 120 may face the partition 15. The sealing member 130 may be provided to seal a gap between the back surface of the front portion 120 and the partition 15 at the insertion position 100A.

The sealing member 130 may be configured to include an elastic material such as rubber. However, the present disclosure is not limited thereto, and the sealing member 130 may be configured to include various other materials.

By the above configuration, at the insertion position 100A, the freezer compartment case 100 may efficiently seal the freezer compartment 22 and the second inner space 10*c* and efficiently prevent leakage of cold air from the freezer compartment 22 and the second inner space 10*c*. This may be important in that the refrigerator compartment 21 and the freezer compartment 22 need to maintain different temperatures even in a case in which the door 30 closes the body 10.

Meanwhile, in order to more efficiently prevent leakage of cold air from the freezer compartment 22 and the second inner space 10*c* at the insertion position 100A, the sealing member 130 may be fixed to the inner case 11 by a magnetic force at the insertion position 100A.

For example, the sealing member 130 may include a first magnetic body 131 configured to include a magnetic material. Corresponding thereto, the inner case 11 may include a second magnetic body 11*aa* configured to include a magnetic material and provided so that an attractive force acts between the first magnetic body 131 and the second magnetic body 11*aa*.

More specifically, the second magnetic body 11*aa* may be provided on an inner surface of the inner case 11 that faces the body insulator 13. The second magnetic body 11*aa* may be embedded by the body insulator 13. More specifically, the second magnetic body 11*aa* may be provided on an inner surface of the front support portion 11*a* that faces the body insulator 13.

The second magnetic body 11*aa* may extend along the periphery of the front support portion 11*a*. The second magnetic body 11*aa* may be formed to have the shape of a substantially flat plate. However, the shape of the second magnetic body 11*aa* is not limited thereto.

At the insertion position 100A, the sealing member 130 may be fixed to the inner case 11 by the attractive force between the first magnetic body 131 and the second magnetic body 11*aa*. Even when the user does not place the freezer compartment case 100 at the exact insertion position 100A, the freezer compartment case 100 may move to the exact insertion position 100A by the attractive force between the first magnetic body 131 and the second magnetic body 11*aa* as long as the freezer compartment case 100 is moved to a position adjacent to the insertion position 100A. The attractive force placing the freezer compartment case to the adjacent position may cause the second inner space 10*c* and the freezer compartment 22 to be sealed.

Alternatively, at the insertion position 100A, the sealing member 130 may be fixed to the partition 15 by a magnetic force.

For example, the partition 15 may include a third magnetic body 15*b* configured to include a magnetic material and provided so that an attractive force acts between the first magnetic body 131 and the third magnetic body 15*b*.

More specifically, the third magnetic body 15*b* may be provided on an inner surface of the partition 15 that faces the partition insulator 15*a*. The third magnetic body 15*b* may be embedded by the partition insulator 15*a*.

The third magnetic body 15*b* may extend in a left-right direction of the body 10 which is a direction in which the partition 15 extends. The third magnetic body 15*b* may be formed to have the shape of a substantially flat plate. However, the shape of the third magnetic body 15*b* is not limited thereto.

At the insertion position 100A, the sealing member 130 may be fixed to the partition 15 by the attractive force between the first magnetic body 131 and the third magnetic body 15*b*. Further, when the user inserts the freezer compartment case 100, even when the user does not place the freezer compartment case 100 at the exact insertion position 100A, as long as the freezer compartment case 100 is moved to a position adjacent to the insertion position 100A, the freezer compartment case 100 may move to the exact insertion position 100A by the attractive force between the first magnetic body 131 and the third magnetic body 15*b*, and the second inner space 10*c* and the freezer compartment 22 may be sealed.

Meanwhile, the terms "first magnetic body," "second magnetic body," and "third magnetic body," described above are only terms defined in describing the magnetic bodies provided on the sealing member 130, the inner case 11, and the partition 15 according to one embodiment, and interpretation of the magnetic bodies is not limited by the expressions "first, "second," and "third." For example, the second magnetic body 11*aa* provided on the inner case 11 and the third magnetic body 15*b* provided on the partition 15 are different only in terms of the arrangement and may be provided so that features such as types or shapes thereof are almost the same.

As described above, the first inner space 10*b* and the second inner space 10*c* may communicate with the cooling chamber 50. Specifically, the refrigerator 1 may further include communication holes 14*a* and 14*b* configured to allow communication between the second inner space 10*c* and the cooling chamber 50.

For example, the communication holes 14*a* and 14*b* may include a first communication hole 14*a* provided so that cold air generated in the cooling chamber 50 is introduced into the second inner space 10*c* and a second communication hole 14*b* provided so that air heat-exchanged in the second inner space 10*c* returns to the cooling chamber 50. The flow of air between the second inner space 10*c* and the cooling chamber 50 through the communication holes 14*a* and 14*b* may occur by the blower fan 72. That is, the refrigerator 1 according to one embodiment may be configured as an indirect-cooling refrigerator.

The communication holes 14*a* and 14*b* may be provided behind the second inner space 10*c*. For example, the communication holes 14*a* and 14*b* may be formed in a front surface of the cold air supply duct 14. For example, the communication holes 14*a* and 14*b* may be formed to pass through one side of the inner case 11.

The freezer compartment case 100 may cover a front of the communication holes 14*a* and 14*b*. Accordingly, in the case in which the freezer compartment case 100 is at the withdrawal position 100B as well as the case in which the freezer compartment case 100 is at the insertion position 100A, the front of the communication holes 14*a* and 14*b* may be covered by the freezer compartment case 100. Accordingly, as long as the freezer compartment case 100 is not completely separated from the second inner space 10*c*, the exterior of the communication holes 14*a* and 14*b* may not be exposed to the user, and further, the exterior quality of the product can be improved.

The freezer compartment case 100 may communicate with the cooling chamber 50. The freezer compartment case 100 may be provided to communicate with the cooling chamber 50 and receive cold air from the cooling chamber 50. In other words, the freezer compartment 22 may communicate with the cooling chamber 50.

The freezer compartment case 100 may communicate with the second inner space 10*c* and may communicate with the cooling chamber 50 via the second inner space 10*c*. In other words, at the insertion position 100A, the freezer compartment 22 may communicate with the second inner space 10*c* and the cooling chamber 50.

For example, the freezer compartment case 100 may include a cold air inlet 112 formed so that cold air enters from behind the freezer compartment case 100. The cold air inlet 112 may be provided in a rear surface of the case body 110. Cold air introduced from the cooling chamber 50 into the second inner space 10*c* may be introduced into the freezer compartment 22 through the cold air inlet 112.

The cold air inlet 112 may be formed in the upper portion of the freezer compartment case 100, more specifically, the upper portion of the case body 110. However, the present disclosure is not limited thereto, and the cold air inlet 112 may be provided at various other positions.

For example, at the insertion position 100A, the above-described freezer compartment opening 111 may be provided to be spaced apart from the lower surface of the partition 15. Cold air introduced from the cooling chamber 50 into the second inner space 10*c* may be introduced into the freezer compartment 22 through a separation space between the freezer compartment opening 111 and the lower surface of the partition 15. Also, as the freezer compartment opening 111 is spaced apart from the lower surface of the partition 15 at the insertion position 100A, the user may easily move the freezer compartment case 100 from the insertion position 100A to the withdrawal position 100B.

The freezer compartment case 100 may include an outlet 113 provided so that air heat-exchanged in the freezer compartment 22 is discharged. The outlet 113 may be provided in the case body 110. The air heat-exchanged in the freezer compartment 22 may be discharged to the second inner space 10*c* through the outlet 113 or may return to the cooling chamber 50 through the second communication hole 14*b*.

The outlet 113 may be formed in a lower portion of the freezer compartment case 100, more specifically, a lower portion of the case body 110. However, the present disclosure is not limited thereto, and the outlet 113 may be provided at various other positions.

Configurations provided so that the freezer compartment case 100 receives cold air are not limited to the above, and the freezer compartment case 100 may communicate with the second inner space 10*c* or the cooling chamber 50 by various other configurations.

Alternatively, for example, the freezer compartment case 100 may not communicate with the second inner space 10*c* and the cooling chamber 50. Even when the second inner space 10*c* communicates with the cooling chamber 50 and receives cold air, the freezer compartment case 100 may include the case body 110 made of a material with high thermal conductivity, and the case body 110 itself may be cooled by cold air of the second inner space 10*c*. Alternatively, for example, in a direct-cooling refrigerator, even when the freezer compartment 22 communicates with the second inner space 10*c*, the second inner space 10*c* may not communicate with the cooling chamber 50.

By the above configuration, the freezer compartment case 100 may, from the cooling chamber 50, receive an amount of cold air sufficient to maintain the temperature of the freezer compartment 22. That is, the freezer compartment 22 may, while being provided in the second inner space 10*c* separated from the first inner space 10*b* by the front portion 120, the sealing member 130, the partition 15, and the like of the freezer compartment case 100, receive cold air through a supply flow path distinct from a supply flow path of cold air introduced into the first inner space 10*b*.

An ice tray 140 configured to form ice may be provided in the freezer compartment case 100. The freezer compartment case 100 may include a tray supporter 150 configured to support the ice tray 140. The tray supporter 150 may be formed to accommodate the ice tray 140 and may be supported by the case body 110.

The case body 110 may include an ice tray guide 117. The ice tray guide 117 may support the tray supporter 150. The ice tray guide 117 may guide movement of the tray supporter 150 in the forward-backward direction.

However, the configurations such as the ice tray 140, the tray supporter 150, and the ice tray guide 117 are not limited to the above description and may be configured in various other ways. An ice making system for ice formation in the freezer compartment 22 may be provided in various ways.

Figure 9:
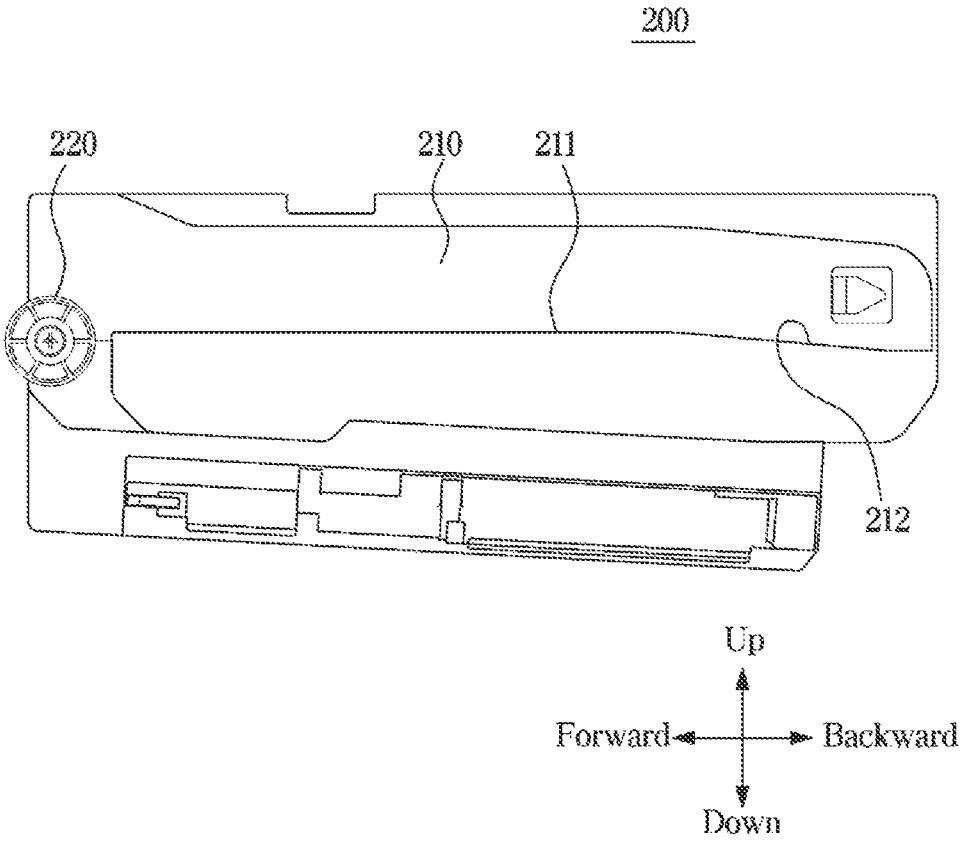
FIG. 9 is a view illustrating a rail of the refrigerator according to one embodiment of the present disclosure.
Figure 10:
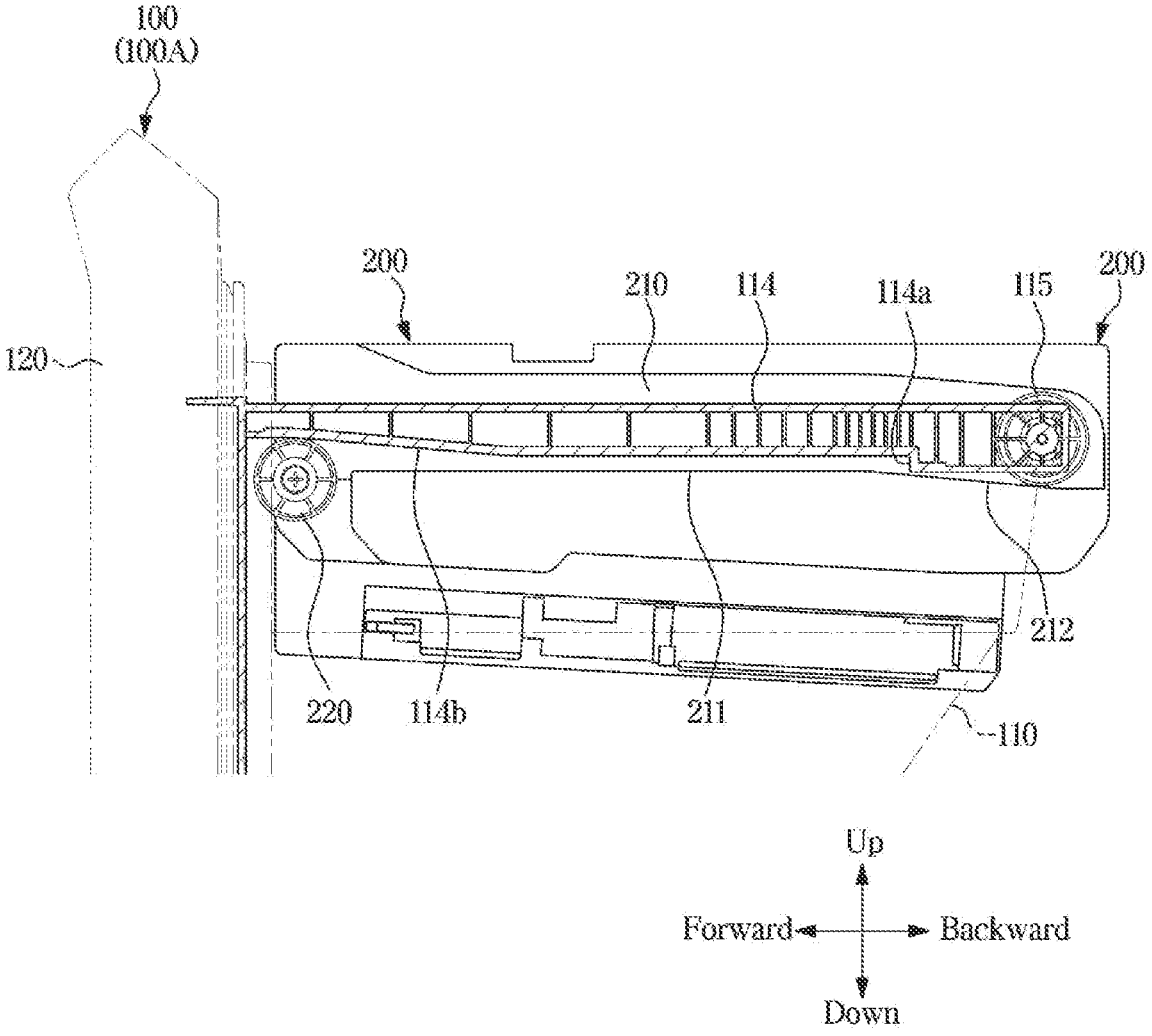
FIG. 10 is a view illustrating a state in which the freezer compartment case moves along the rail in the refrigerator according to one embodiment of the present disclosure.
Figure 11:
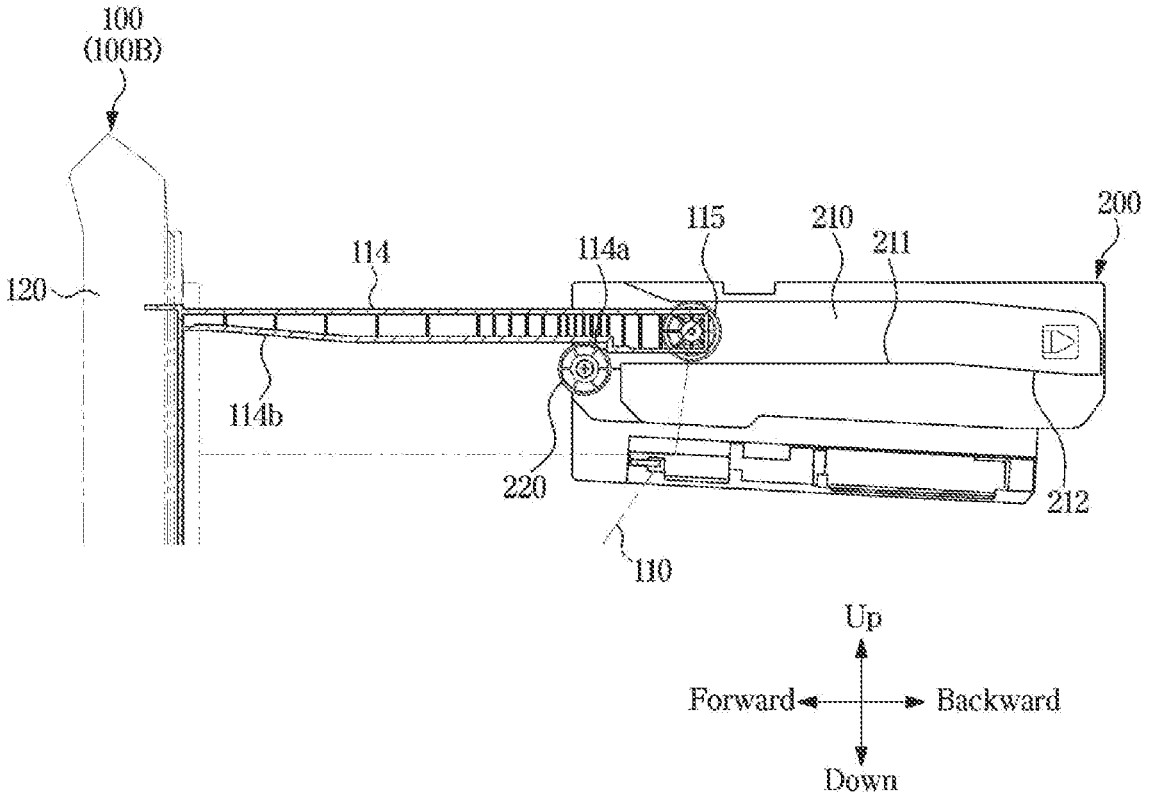
FIG. 11 is a view illustrating a state in which the freezer compartment case moves along the rail in the refrigerator according to one embodiment of the present disclosure.
Figure 12:
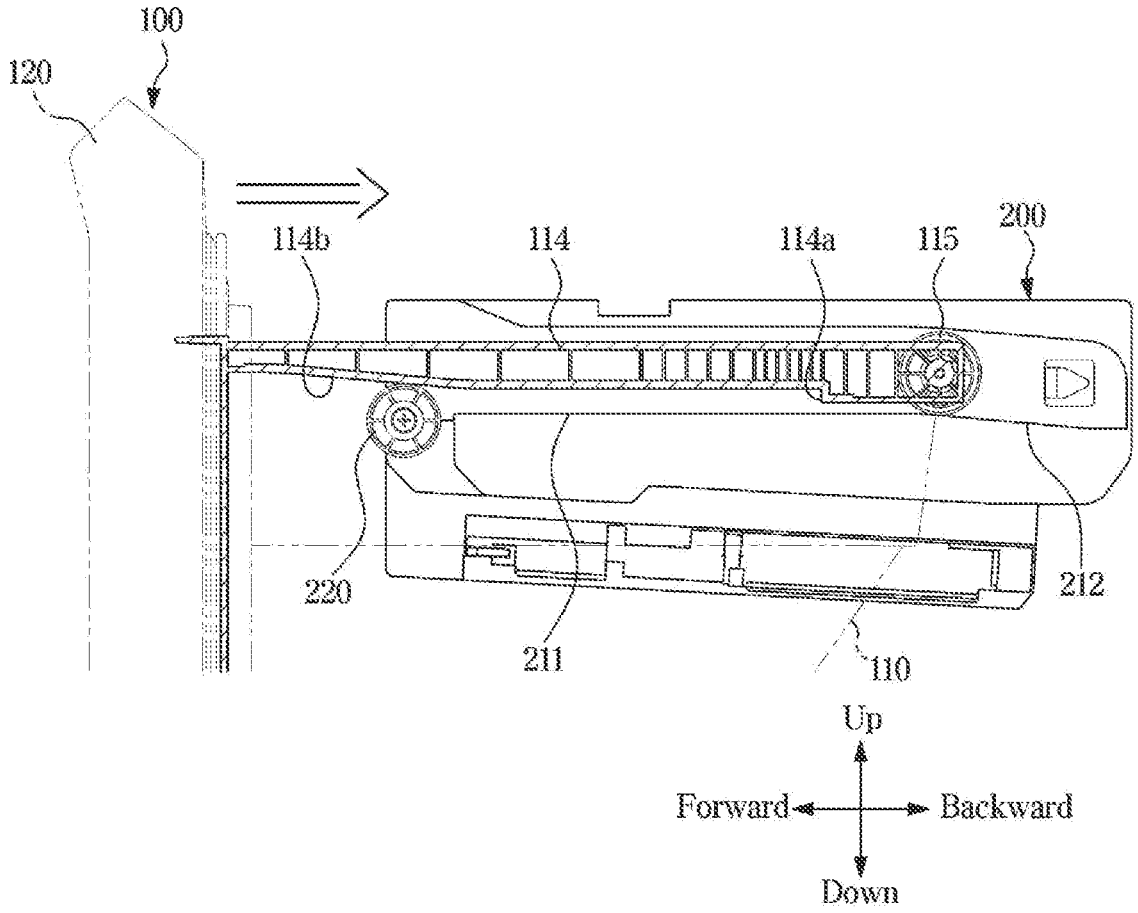
FIG. 12 is a view illustrating a state in which the freezer compartment case moves along the rail in the refrigerator according to one embodiment of the present disclosure.

FIG. 9 is a view illustrating a rail of the refrigerator according to one embodiment of the present disclosure. FIG. 10 is a view illustrating a state in which the freezer compartment case moves along the rail in the refrigerator according to one embodiment of the present disclosure. FIG. 11 is a view illustrating a state in which the freezer compartment case moves along the rail in the refrigerator according to one embodiment of the present disclosure. FIG. 12 is a view illustrating a state in which the freezer compartment case moves along the rail in the refrigerator according to one embodiment of the present disclosure.

Referring to FIGS. 9 to 12, the refrigerator 1 may include the rail 200 provided to allow the freezer compartment case 100 to be slidable between the insertion position 100A and the withdrawal position 100B. The freezer compartment case 100 may be provided to be slidable in the forward-backward direction along the rail 200. The rail 200 may movably support the freezer compartment case 100.

The rail 200 may be provided in the second inner space 10*c*. For example, on the inner wall of the inner case 11, the rail 200 may be mounted on a portion of an inner wall forming the second inner space 10*c*. For example, on the inner wall of the inner case 11, the rail 200 may be integrally formed with the portion of the inner wall forming the second inner space 10*c*.

For example, the rail 200 may include a rail groove 210 configured to guide sliding of the freezer compartment case 100 and include a concave shape. The freezer compartment case 100 may move between the insertion position 100A and the withdrawal position 100B along the rail groove 210. The rail groove 210 may extend in the forward-backward direction of the refrigerator 1.

The freezer compartment case 100 may include a case insertion portion 114 inserted into the rail groove 210. Movement of the case insertion portion 114 in the forward-backward direction may be guided by the rail groove 210. The case insertion portion 114 may insert into the rail groove 210 and supported. The case insertion portion 114 may be provided at the case body 110. More specifically, the case insertion portion 114 may be provided at both side surfaces of the case body 110. The case insertion portion 114 may extend in the forward-backward direction of the freezer compartment case 100.

For example, the freezer compartment case 100 may include a case roller 115. The case roller 115 may be provided to roll along the rail groove 210 while the freezer compartment case 100 slides. The case roller 115 may roll due to friction generated between the case roller 115 and the rail groove 210 while the freezer compartment case 100 slides. Due to the case roller 115, the freezer compartment case 100 may easily move along the rail 200.

For example, the case roller 115 may be provided to be rotatable about a rotating shaft provided at the case insertion portion 114. The case roller 115 may be disposed at a position adjacent to a rear end of the case insertion portion 114. The case roller 115 may be disposed adjacent to one end of the case insertion portion 114 in the direction in which the freezer compartment case 100 is inserted. Depending on the length at which the rail groove 210 extends, the case roller 115 at the insertion position 100A may reach a rear end of the rail groove 210.

The case roller 115 may be formed to have a substantially disk-like shape, but the shape of the case roller 115 is not limited thereto.

For example, the rail 200 may include a rail roller 220. The rail roller 220 may be provided to roll along the case insertion portion 114 while the freezer compartment case 100 slides along the rail 200. The rail roller 220 may roll due to friction generated between the rail roller 220 and the case insertion portion 114 while the freezer compartment case 100 slides. Due to the rail roller 220, the freezer compartment case 100 may easily move along the rail 200.

For example, the rail roller 220 may be provided to be rotatable about a rotating shaft provided at the rail 200. The rail roller 220 may be disposed at a position adjacent to a front end of the rail groove 210. The rail roller 220 may be disposed adjacent to one end of the rail groove 210 in the direction in which the freezer compartment case 100 is withdrawn.

The rail roller 220 may be formed to have a substantially disk-like shape, but the shape of the rail roller 220 is not limited thereto.

A case stopper 114*a* provided to prevent forward movement of the freezer compartment case 100 once the freezer compartment case 100 reaches the withdrawal position 100B may be provided at the case insertion portion 114. The case stopper 114*a* may come in contact with the rail 200 in the forward-backward direction at the withdrawal position 100B and prevent the freezer compartment case 100 from being withdrawn forward past the withdrawal position 100B.

For example, the case stopper 114*a* may come in contact with the rail roller 220 in the forward-backward direction at the withdrawal position 100B and prevent the freezer compartment case 100 from being withdrawn forward past the withdrawal position 100B.

For example, the case stopper 114*a* may be formed so that a step is present between an area of the case insertion portion 114 positioned in front of the case stopper 114*a* and an area of the case insertion portion 114 positioned behind the case stopper 114*a*.

However, the present disclosure is not limited thereto, and for example, a separate stopper structure (not illustrated) provided to come in contact with the case roller 115 in the forward-backward direction and prevent the freezer compartment case 100 from being withdrawn forward past the withdrawal position 100B once the freezer compartment case 100 reaches the withdrawal position 100B may be formed at the rail groove 210.

By the above configuration, the freezer compartment case 100 may be provided to be slidable between the insertion position 100A and the withdrawal position 100B along the rail 200.

In order to more efficiently prevent leakage of cold air from the freezer compartment 22 and the second inner space 10*c* while the freezer compartment case 100 is at the insertion position 100A, the refrigerator 1 according to one embodiment may further include a structure provided to receive an external force heading toward the insertion position 100A once the freezer compartment case 100 reaches a position at least adjacent to the insertion position 100A.

For example, the rail 200 may include an inclined guide portion 212 formed to be inclined downward toward a rear of the second inner space 10*c*. The inclined guide portion 212 may be formed to be inclined downward toward the direction in which the freezer compartment case 100 is inserted.

The inclined guide portion 212 may be provided at least at a rear of the rail 200.

The inclined guide portion 212 may be provided on the rail groove 210. The inclined guide portion 212 may be provided on a lower surface of the rail groove 210. The inclined guide portion 212 may be provided at least at a rear of the rail groove 210.

While the freezer compartment case 100 moves from the withdrawal position 100B to the insertion position 100A, the freezer compartment case 100 may enter the inclined guide portion 212. After the freezer compartment case 100 enters the inclined guide portion 212, the freezer compartment case 100 may move backward due to a self-load of the freezer compartment case 100 along a downward-inclined surface of the inclined guide portion 212 and may easily move to the insertion position 100A.

For example, as illustrated in FIG. 12, while the freezer compartment case 100 moves from the withdrawal position 100B to the insertion position 100A, the case roller 115 of the freezer compartment case 100 may enter the inclined guide portion 212. After the case roller 115 enters the inclined guide portion 212, the case roller 115 may roll to move backward along the downward-inclined surface of the inclined guide portion 212. Accordingly, the freezer compartment case 100 may easily move to the insertion position 100A.

As the rail 200 includes the inclined guide portion 212, the freezer compartment case 100 may easily move to the insertion position 100A, and the freezer compartment case 100 may efficiently seal the freezer compartment 22 and the second inner space 10*c* and prevent leakage of cold air therefrom.

For example, the rail 200 may include a horizontal guide portion 211 disposed in front of the inclined guide portion 212. The horizontal guide portion 211 may extend in a direction parallel to the forward-backward direction of the second inner space 10*c*.

More specifically, the horizontal guide portion 211 may be bent from one end at a front of the inclined guide portion 212 and extend in the direction parallel to the forward-backward direction of the second inner space 10*c*. In other words, the inclined guide portion 212 may be bent from one end at a rear of the horizontal guide portion 211 and extend in a direction inclined downward toward the rear of the second inner space 10*c*.

The horizontal guide portion 211 may be provided at least at a front of the rail 200.

The horizontal guide portion 211 may be provided on the rail groove 210. The horizontal guide portion 211 may be provided on the lower surface of the rail groove 210. The horizontal guide portion 211 may be provided at least at a front of the rail groove 210.

While the freezer compartment case 100 moves from the withdrawal position 100B to the insertion position 100A along the horizontal guide portion 211, the freezer compartment case 100 may be able to slide parallel to the forward-backward direction. Here, the freezer compartment case 100 may move only by a force caused by the user inserting and pushing the freezer compartment case 100 backward. Once the freezer compartment case 100 enters the inclined guide portion 212 from the horizontal guide portion 211, the freezer compartment case 100 can move to the insertion position 100A without the force caused by the user pushing the freezer compartment case 100 due to the self-load of the freezer compartment case 100.

Conversely, while the freezer compartment case 100 moves from the insertion position 100A to the withdrawal position 100B along the horizontal guide portion 211, the freezer compartment case 100 may enter the horizontal guide portion 211. After the freezer compartment case 100 enters the horizontal guide portion 211, the freezer compartment case 100 may be able to slide parallel to the forward-backward direction.

For example, while the case roller 115 of the freezer compartment case 100 is moving from the withdrawal position 100B to the insertion position 100A along the horizontal guide portion 211, the freezer compartment case 100 may be able to slide parallel to the forward-backward direction. Here, the freezer compartment case 100 may move only by the force caused by the user inserting and pushing the freezer compartment case 100 backward.

Conversely, while the freezer compartment case 100 is moving from the insertion position 100A to the withdrawal position 100B along the horizontal guide portion 211, the case roller 115 may enter the horizontal guide portion 211. After the freezer compartment case 100 enters the horizontal guide portion 211, the freezer compartment case 100 may be able to slide parallel to the forward-backward direction.

As the rail 200 includes the horizontal guide portion 211, at the withdrawal position 100B or a position adjacent to the withdrawal position 100B, movement of the freezer compartment case 100 may be prevented due to the self-load of the freezer compartment case 100.

Alternatively, for example, the freezer compartment case 100 may include a case inclined portion 114*b* formed to be inclined upward toward the front of the freezer compartment case 100. In other words, the case inclined portion 114*b* may be formed to be inclined downward toward the rear of the freezer compartment case 100. The case inclined portion 114*b* may be formed to be inclined downward toward the direction in which the freezer compartment case 100 is inserted.

The case inclined portion 114*b* may be provided at least at a front of the case body 110.

The case inclined portion 114*b* may be provided on the case insertion portion 114. The case inclined portion 114*b* may be provided on a lower surface of the case insertion portion 114. The case inclined portion 114*b* may be provided at least at a front of the case insertion portion 114.

While the freezer compartment case 100 moves from the withdrawal position 100B to the insertion position 100A, the case inclined portion 114*b* may enter the rail 200. After the case inclined portion 114*b* enters the rail 200, the case inclined portion 114*b* may be guided by the rail 200, and the freezer compartment case 100 may move backward due to the self-load of the freezer compartment case 100. Accordingly, the freezer compartment case 100 may easily move to the insertion position 100A.

For example, as illustrated in FIG. 12, while the freezer compartment case 100 moves from the withdrawal position 100B to the insertion position 100A, the case inclined portion 114*b* of the freezer compartment case 100 may enter the position of the rail roller 220. After the case inclined portion 114*b* enters the position of the rail roller 220, the rail roller 220 may roll on the inclined surface of the case inclined portion 114*b*, and due to the rotation of the rail roller 220, the freezer compartment case 100 may move backward. Accordingly, the freezer compartment case 100 may easily move to the insertion position 100A.

As the freezer compartment case 100 includes the case inclined portion 114*b*, the freezer compartment case 100 may easily move to the insertion position 100A, and the freezer compartment case 100 may efficiently seal the freezer compartment 22 and the second inner space 10*c* and prevent leakage of cold air therefrom.

However, the rail 200 of the refrigerator 1 according to one embodiment which has been described above is only an example of a rail 200 supporting the freezer compartment case 100 to allow sliding of the freezer compartment case 100. The spirit of the present disclosure is not limited thereto, and a rail included in the refrigerator according to the spirit of the present disclosure may be provided to have various other configurations.

Figure 13:
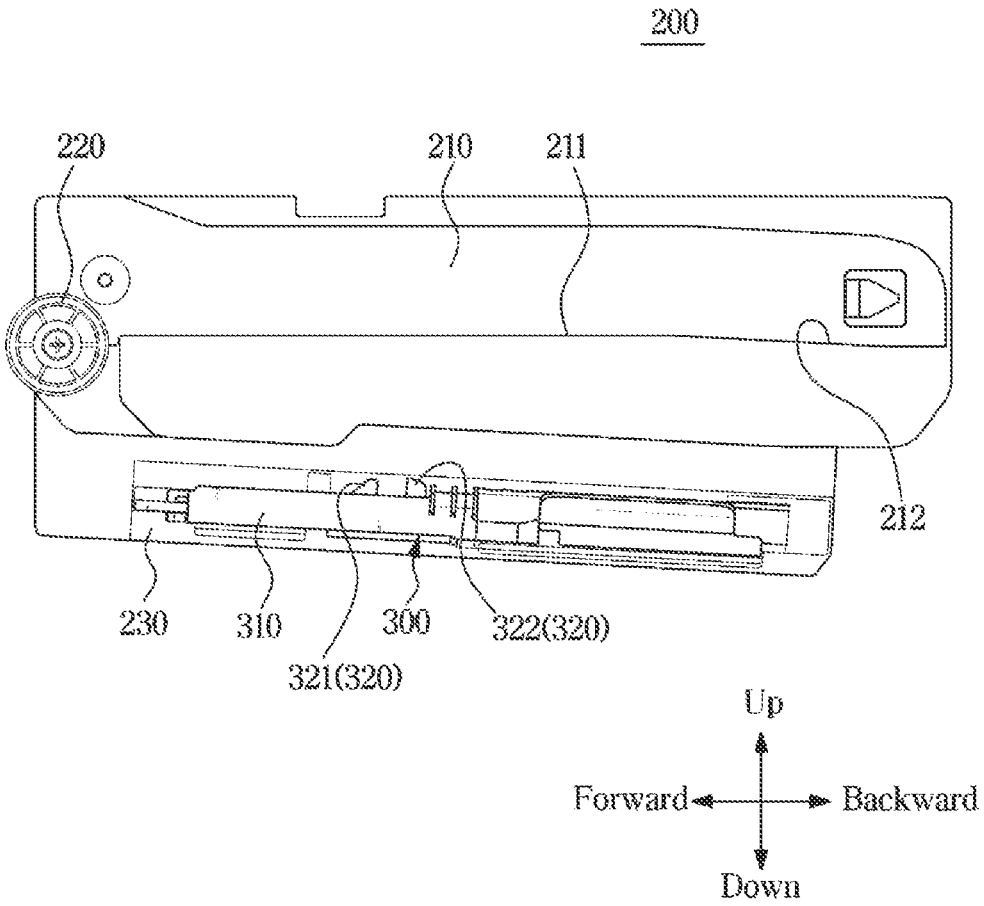
FIG. 13 is a view illustrating the rail and a closing device of the refrigerator according to one embodiment of the present disclosure.
Figure 14:
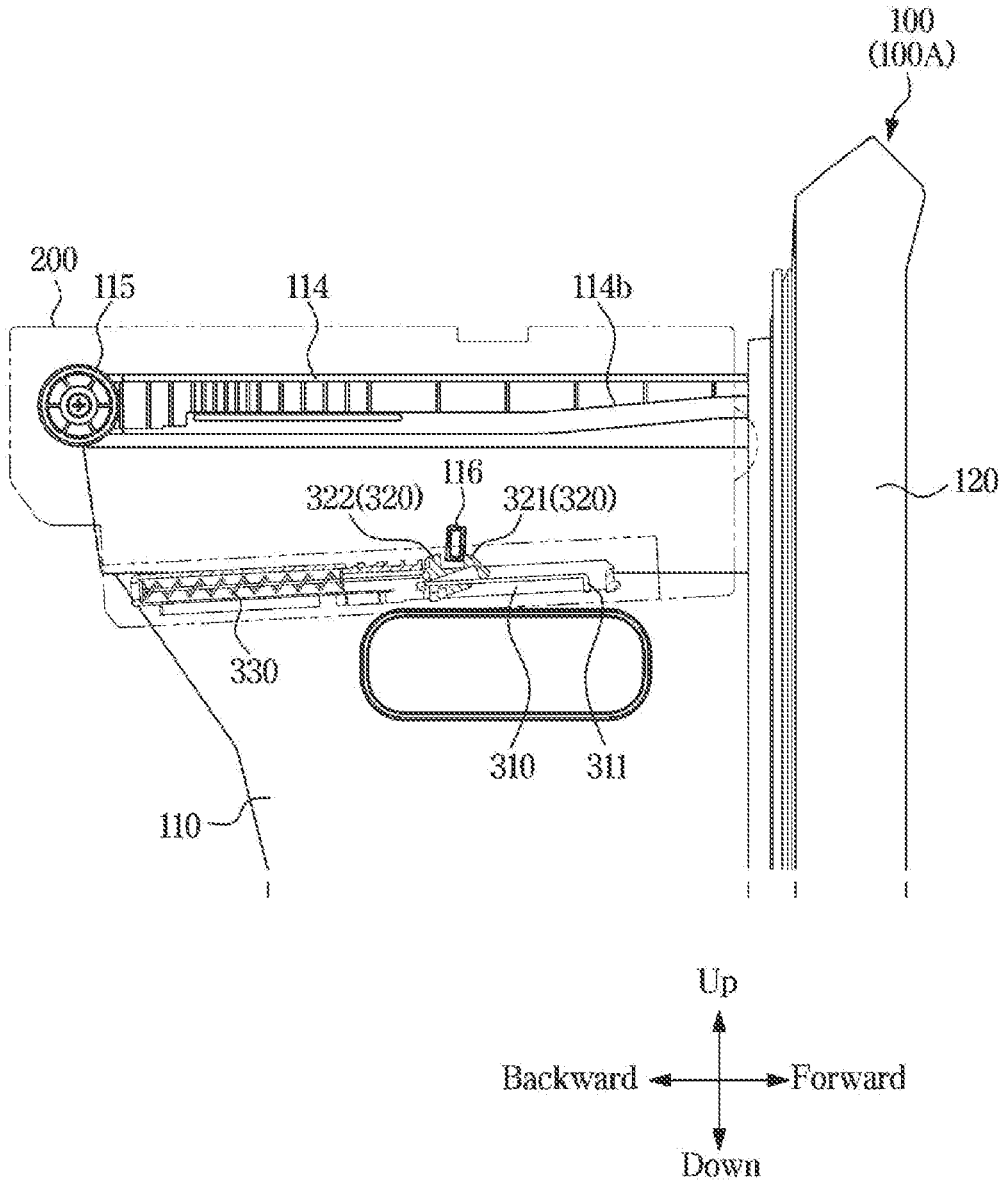
FIG. 14 is a view illustrating a state in which the freezer compartment case is withdrawn, in the refrigerator according to one embodiment of the present disclosure.
Figure 15:
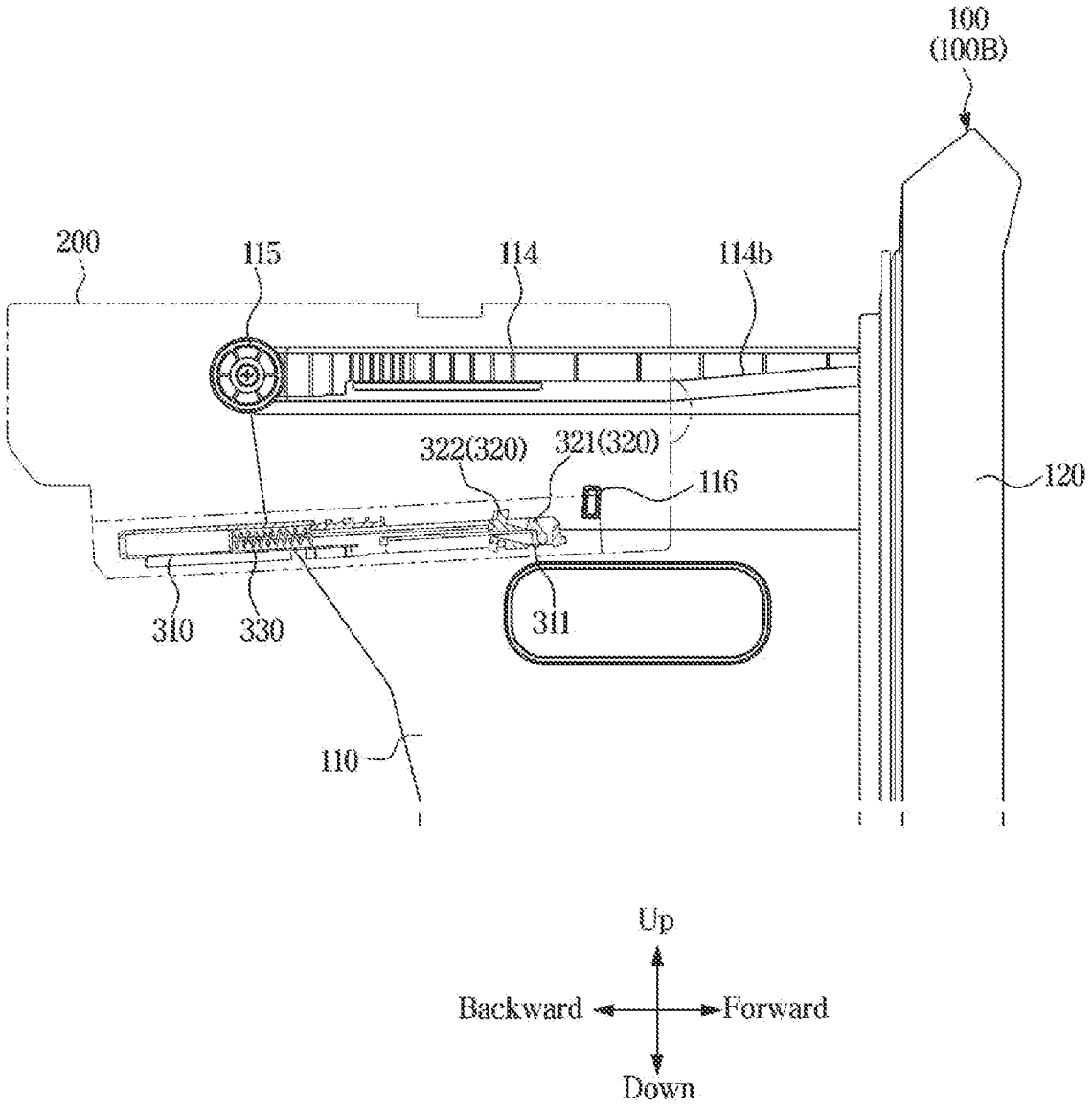
FIG. 15 is a view illustrating a state in which the freezer compartment case is inserted, in the refrigerator according to one embodiment of the present disclosure.

FIG. 13 is a view illustrating the rail and a closing device of the refrigerator according to one embodiment of the present disclosure. FIG. 14 is a view illustrating a state in which the freezer compartment case is withdrawn, in the refrigerator according to one embodiment of the present disclosure. FIG. 15 is a view illustrating a state in which the freezer compartment case is inserted, in the refrigerator according to one embodiment of the present disclosure.

As described above, in order to more efficiently prevent leakage of cold air from the freezer compartment 22 and the second inner space 10*c* while the freezer compartment case 100 is at the insertion position 100A, the refrigerator 1 according to one embodiment may further include a structure provided to receive an external force heading toward the insertion position 100A once the freezer compartment case 100 reaches a position at least adjacent to the insertion position 100A.

For example, referring to FIGS. 13 to 15, the refrigerator 1 may further include a closing device 300 configured to provide an elastic force so that the freezer compartment case 100 moves to the insertion position 100A.

The closing device 300 may be provided in the second inner space 10*c*. In the second inner space 10*c*, the closing device 300 may be provided to face the freezer compartment case 100. For example, in the second inner space 10*c*, the closing device 300 may be provided to face the left side or right side of the case body 110. For example, in the second inner space 10*c*, the closing device 300 may be provided to face a rear of the case body 110.

For example, the rail 200 may include a closing device mounting portion 230 provided so that the closing device 300 is mounted on the rail 200. The closing device 300 may be mounted on the closing device mounting portion 230 and provided in the second inner space 10*c*. The closing device 300 may be mounted on each of the plurality of rails 200 mounted on the left-side inner wall and the right-side inner wall of the inner case 11. The closing device 300 may be fixed to the rail 200.

On the other hand, for example, the closing device 300 may be directly mounted on the inner wall of the inner case 11 without being mounted on the rail 200. For example, the closing device 300 may be mounted on each of the left-side inner wall and the right-side inner wall of the inner case 11.

The closing device 300 may be provided to provide an elastic force to the freezer compartment case 100 in a direction toward the insertion position 100A from a position at which the freezer compartment case 100 is withdrawn by a predetermined distance forward from the insertion position 100A (hereinafter referred to as a "closing position" of the freezer compartment case 100).

The closing position may be designated as a specific position between the insertion position 100A and the withdrawal position 100B. The closing position may be set to various positions according to the product design.

When placed between the insertion position 100A and the closing position, the freezer compartment case 100 may receive an elastic force in the direction toward the insertion position 100A by the closing device 300. In such a case, when the freezer compartment case 100 is placed between the insertion position 100A and the closing position, the freezer compartment case 100 may move to the insertion position 100A due to the closing device 300 unless a separate external force withdrawing the freezer compartment case 100 is applied.

When placed between the withdrawal position 100B and the closing position, the freezer compartment case 100 may not receive an elastic force toward the insertion position 100A by the closing device 300. In such a case, the freezer compartment case 100 may maintain the current position without moving in the forward-backward direction unless a separate external force moving the freezer compartment case 100 in the forward-backward direction is applied.

Hereinafter, one example of the closing device provided in the refrigerator according to the spirit of the present disclosure will be described.

The closing device 300 may include a closing body 310 fixed to the inner case 11, a puller 320 provided to be movable in the forward-backward direction relative to the closing body 310, and an elastic spring 330 having one end fixed to the closing body 310 and the other end connected to the puller 320.

For example, the closing body 310 may be fixed to the closing device mounting portion 230 of the rail 200.

The elastic spring 330 may be fixed to the inner case 11 by the one end thereof being fixed to the closing body 310. The other end of the elastic spring 330 may be provided to be connected to the puller 320 and provide an elastic force to the puller 320 according to the position of the puller 320. When the freezer compartment case 100 is placed in front of the insertion position 100A, the elastic spring 330 may be elastically biased to move the freezer compartment case 100 to the insertion position 100A.

As illustrated in FIGS. 13 to 15, the elastic spring 330 may be a compression spring. In such a case, the one end of the elastic spring 330 fixed to the closing body 310 may be a front end of the elastic spring 330 in the direction toward the front of the refrigerator 1. The other end of the elastic spring 330 connected to the puller 320 may be a rear end of the elastic spring 330 in the direction toward the rear of the refrigerator 1.

However, on the other hand, for example, the elastic spring 330 may be an extension spring. In such a case, the one end of the elastic spring 330 fixed to the closing body 310 may be a rear end of the elastic spring 330 in the direction toward the rear of the refrigerator 1. The other end of the elastic spring 330 connected to the puller 320 may be a front end of the elastic spring 330 in the direction toward the front of the refrigerator 1.

Hereinafter, description will be given based on the case in which the elastic spring 330 is a compression spring as illustrated in FIGS. 13 to 15.

The freezer compartment case 100 may include a puller contact portion 116 provided to come in contact with the puller 320. The puller contact portion 116 may be provided at the case body 110. The puller contact portion 116 may have a shape that protrudes toward the puller 320. For example, the puller contact portion 116 may be formed to have a shape that protrudes from each of a left side surface and a right side surface of the case body 110. However, the present disclosure is not limited thereto, and the puller contact portion 116 may be formed to have various other shapes.

While the freezer compartment case 100 moves from the insertion position 100A to the withdrawal position 100B, the puller 320 may come in contact with the puller contact portion 116 and move forward. While the freezer compartment case 100 moves from the withdrawal position 100B to the insertion position 100A, the puller 320 may come in contact with the puller contact portion 116 and move backward.

The puller 320 may include a first contact portion 321 and a second contact portion 322 provided to come in contact with the puller contact portion 116. The first contact portion 321 may be disposed in front of the second contact portion 322. The first contact portion 321 and the second contact portion 322 may be disposed to be spaced apart from each other in the forward-backward direction.

At the insertion position 100A, the puller contact portion 116 may be placed between the first contact portion 321 and the second contact portion 322. While the freezer compartment case 100 moves from the insertion position 100A to the withdrawal position 100B, the puller contact portion 116 may press the first contact portion 321 forward and move the puller 320 forward. While the freezer compartment case 100 moves from the withdrawal position 100B to the insertion position 100A, the puller contact portion 116 may press the second contact portion 322 backward and move the puller 320 backward, and likewise, the first contact portion 321 may press the puller contact portion 116 backward and move the freezer compartment case 100 backward.

While the freezer compartment case 100 moves to the withdrawal position 100B, the puller 320 moved to the front may be locked to the closing body 310.

For example, a groove provided to allow the puller 320 to move in the forward-backward direction along the closing body 310 may be provided in the closing body 310. While the freezer compartment case 100 moves to the withdrawal position 100B, the puller 320 may move forward as the puller contact portion 116 presses the first contact portion 321 forward. A catching portion 311 formed to prevent backward movement of the puller 320 that has reached a front of the groove may be provided at the closing body 310. Once the freezer compartment case 100 reaches the closing position, the first contact portion 321 may be locked to the catching portion 311 of the closing body 310.

When locked by the catching portion 311, the first contact portion 321 may insert towards the inside of the closing body 310. While the freezer compartment case 100 moves from the closing position to the withdrawal position 100B, the first contact portion 321 may remain inserted into the closing body 310, and the puller contact portion 116 may be withdrawn forward without restraint by the first contact portion 321.

While the freezer compartment case 100 moves to the insertion position 100A, the puller 320 may be unlocked from the closing body 310. The unlocked puller 320 may move backward and may be provided to pull the freezer compartment case 100 toward the insertion position 100A.

For example, since, as mentioned above, the first contact portion 321 remains inserted into the closing body 310 while the freezer compartment case 100 moves from the closing position to the withdrawal position 100B, the puller contact portion 116 may reach the second contact portion 322 while the freezer compartment case 100 moves back to the closing position from the withdrawal position 100B. At the closing position, the puller contact portion 116 may press the second contact portion 322 backward. While the freezer compartment case 100 moves from the closing position to the insertion position 100A, as the second contact portion 322 is pressed backward by the puller contact portion 116, the first contact portion 321 locked to the catching portion 311 may be unlocked from the catching portion 311. That is, the puller 320 may be unlocked from the closing body 310.

The puller 320 unlocked from the closing body 310 may receive an elastic force by the elastic spring 330. The puller 320 may receive an elastic force heading toward the rear of the refrigerator 1, and the puller contact portion 116 may be pressed backward by the first contact portion 321. Accordingly, the puller 320 may be provided to move backward and pull the freezer compartment case 100 toward the insertion position 100A.

By the above configuration, even when not directly moved to the insertion position 100A by the user, the freezer compartment case 100 may move to the insertion position 100A by the closing device 300 as long as the freezer compartment case 100 is moved to the closing position. Accordingly, the freezer compartment case 100 may efficiently seal the freezer compartment 22 and the second inner space 10*c* and prevent leakage of cold air therefrom.

However, the present disclosure is not limited thereto, and the closing device provided in the refrigerator according to the spirit of the present disclosure may be configured in various other ways.

Although it is illustrated in FIGS. 13 to 15 that the above-described inclined guide portion 212 is provided at the rail 200 and the above-described case inclined portion 114*b* is provided at the freezer compartment case 100 even when the closing device 300 is provided, the present disclosure is not limited thereto.

According to one embodiment, the inclined guide portion 212 may not be provided at the rail 200, and the case inclined portion 114*b* may not be provided at the freezer compartment case 100. Even in such a case, since the refrigerator 1 includes the closing device 300, the freezer compartment case 100 may easily move to the insertion position 100A, and the freezer compartment case 100 may efficiently seal the freezer compartment 22 and the second inner space 10*c* and prevent leakage of cold air therefrom.

According to the spirit of the present disclosure, a refrigerator may include a freezer compartment case configured to have a front covered by a door, and a storage compartment opened and closed by the single door may be partitioned into a refrigerator compartment and a freezer compartment.

According to the spirit of the present disclosure, a refrigerator may include a freezer compartment case provided to be slidable to insert into or withdraw from a lower space of a body, and a freezer compartment configured to insert and withdraw may be provided at a lower portion of a storage compartment.

According to the spirit of the present disclosure, a freezer compartment case of a refrigerator may include a sealing member configured to face a partition or an inner case to prevent leakage of cold air from a freezer compartment.

According to the spirit of the present disclosure, a rail of a refrigerator may include an inclined guide portion formed to be inclined downward toward a rear to prevent leakage of cold air from a freezer compartment.

According to the spirit of the present disclosure, a refrigerator may include a closing device, which is configured to provide an elastic force so that a freezer compartment case moves in a direction in which the freezer compartment case is inserted, to prevent leakage of cold air from a freezer compartment.

Specific embodiments illustrated in the drawings have been described above. However, the present disclosure is not limited to the embodiments described above, and those of ordinary skill in the art to which the disclosure pertains may make various changes thereto without departing from the gist of the technical spirit of the disclosure defined in the claims below.

Although the present disclosure has been described with various embodiments, various changes and modifications may be suggested to one skilled in the art. It is intended that the present disclosure encompass such changes and modifications as fall within the scope of the appended claims.

What is claimed is:

1. A refrigerator comprising:

a body including:

an opening formed in a front surface, a partition configured to partition the body into a first inner space and a second inner space so that the first inner space and the second inner space are insulated from each other, and the partition includes a partition insulator provided inside the partition, an outer case configured to form an exterior of the body, an inner case provided inside the outer case, and a body insulator foamed between the outer case and the inner case;

a door rotatably coupled to the body and configured to open and close the opening of the body;

a refrigerator compartment provided in the first inner space of the body; and a freezer compartment case provided with a freezer compartment to insert into or withdraw from the second inner space of the body that is disposed under the first inner space, and configured to:

slide in a forward-backward direction between an insertion position at which the freezer compartment case is inserted into the second inner space and closes the freezer compartment and a withdrawal position at which the freezer compartment case is withdrawn from the second inner space and opens the freezer compartment, wherein a front of the freezer compartment case is covered by the door at the insertion position in a state in which the door closes the opening of the body, wherein the freezer compartment case includes a front portion configured to cover a front of the freezer compartment and a sealing member provided on a back surface of the front portion that faces the inner case and configured to seal between the front portion and the inner case and the partition at the insertion position, wherein at the insertion position, the front portion covers at least a portion of the partition from in front of the partition, and wherein the sealing member includes a first magnetic body and the inner case includes a second magnetic body corresponding to the first magnetic body and provided on an inner surface of the inner case that faces the body insulator, such that at the insertion position, the sealing member simultaneously contacts and is fixed to both the inner case and the partition by a magnetic force, and the partition includes a third magnetic body corresponding to the first magnetic body and provided on an inner surface of the partition that faces the partition insulator, such that at the insertion position, the sealing member is fixed to the partition by a magnetic force.

2. The refrigerator of claim 1, wherein:

the door covers a front of the partition while closing the opening of the body; and the freezer compartment case is provided so that, at the insertion position, a top of the freezer compartment is covered by the partition.

3. The refrigerator of claim 1, wherein:

the freezer compartment case further includes a freezer compartment opening formed in an upper portion of the freezer compartment case and configured to open the freezer compartment; and at the insertion position, the freezer compartment opening is disposed to be spaced apart from a lower surface of the partition.

4. The refrigerator of claim 1, wherein the freezer compartment case includes a case insulator configured to insulate the first inner space from the freezer compartment at the insertion position.

5. The refrigerator of claim 1, further comprising:

a cooling chamber disposed behind the second inner space;

an evaporator provided in the cooling chamber and configured to generate cold air;

a blower fan provided in the cooling chamber and configured to allow the cold air generated by the evaporator to flow are provided; and a communication hole configured to allow communication between the second inner space and the cooling chamber, wherein the freezer compartment case is configured to cover a front of the communication hole.

6. The refrigerator of claim 5, wherein, at the insertion position, the freezer compartment is configured to communicate with the second inner space and the cooling chamber.

7. The refrigerator of claim 5, wherein:

the freezer compartment case includes a cold air inlet formed so that the cold air enters from behind the freezer compartment case; and the cold air inlet is formed in an upper portion of the freezer compartment case.

8. The refrigerator of claim 1, further comprising a rail provided in the second inner space and configured to support the freezer compartment case so that the freezer compartment case is slidable between the insertion position and the withdrawal position, wherein the rail includes an inclined guide portion formed to be inclined downward toward a rear of the second inner space.

9. The refrigerator of claim 8, wherein:

the rail further includes a horizontal guide portion disposed in front of the inclined guide portion; and the horizontal guide portion is bent from one end at a front of the inclined guide portion and extends in a direction parallel to a forward-backward direction of the second inner space.

10. The refrigerator of claim 8, wherein:

the freezer compartment case includes a case insertion portion configured to insert into the rail and guided by the rail; and the case insertion portion includes a case inclined portion formed to be inclined upward toward a front of the freezer compartment case.

11. The refrigerator of claim 1, further comprising a closing device configured to provide an elastic force so that the freezer compartment case moves to the insertion position, wherein the closing device is provided in the second inner space.

12. The refrigerator of claim 11, wherein the closing device includes:

a closing body fixed to an inner case, an elastic spring including an end fixed to the closing body, and a puller connected to another end of the elastic spring and provided to be movable in the forward-backward direction relative to the closing body, wherein the puller is configured to:

in response to the freezer compartment case moving to the withdrawal position, move to a front and locked to the closing body, and in response to the freezer compartment case moving to the insertion position, unlock from the closing body, move to a rear, and pull the freezer compartment case toward the insertion position.

13. A refrigerator comprising:

an outer case configured to form an exterior;

an inner case including a first inner space, in which a refrigerator compartment is provided;

a body insulator foamed between the outer case and the inner case;

a second inner space disposed under the first inner space and provided in the inner case;

a partition disposed inside the inner case configured to partition the inner case into the first inner space and the second inner space, and including a partition insulator provided inside the partition;

a freezer compartment case configured to slide to insert into or withdraw from the second inner space and have a freezer compartment provided therein; and a door rotatably coupled to the outer case and configured to cover a front of the freezer compartment case and a front of the partition while closing the first inner space, wherein the freezer compartment case is provided so that the freezer compartment is open while the freezer compartment case is withdrawn from the second inner space and the freezer compartment is closed by the partition while the freezer compartment case is inserted into the second inner space, wherein the freezer compartment case includes a front portion configured to cover a front of the freezer compartment, and a sealing member provided on a back surface of the front portion that faces the inner case and configured to seal between the front portion and the inner case and the partition at the insertion position, wherein, while the freezer compartment case is inserted into the second inner space, the front portion is configured to cover at least a portion of the partition from in front of the partition, and wherein the sealing member includes a first magnetic body and the inner case includes a second magnetic body corresponding to the first magnetic body and provided on an inner surface of the inner case that faces the body insulator, such that at the insertion position, the sealing member simultaneously contacts and is fixed to both the inner case and the partition by a magnetic force, and the partition includes a third magnetic body corresponding to the first magnetic body and provided on an inner surface of the partition that faces the partition insulator, such that at the insertion position, the sealing member is fixed to the partition by a magnetic force.

14. A refrigerator comprising:

a body including:

an open front;

a partition configured to partition the body into a first inner space and a second inner space so that the first inner space and the second inner space are insulated from each other, and the partition includes a partition insulator provided inside the partition, an outer case configured to form an exterior of the body, an inner case provided inside the outer case, and a body insulator foamed between the outer case and the inner case;

a door rotatably coupled to the body to open and close the body;

a storage compartment provided inside the body and including a refrigerator compartment and a freezer compartment provided under the refrigerator compartment;

a cooling chamber provided inside the body;

an evaporator provided in the cooling chamber and configured to generate cold air;

a blower fan provided in the cooling chamber and configured to allow the generated cold air to flow to the storage compartment are disposed; and a freezer compartment case provided inside the body, configured to slide in a forward-backward direction to open and close the freezer compartment, and configured to communicate with the cooling chamber, wherein the door may cover a front of the freezer compartment case while closing the body, wherein the freezer compartment case includes a front portion configured to cover a front of the freezer compartment, and a sealing member provided on a back surface of the front portion that faces the inner case and configured to seal between the front portion and the inner case and the partition at the insertion position, wherein, while the freezer compartment case is inserted into the second inner space, the front portion is configured to cover at least a portion of the partition from in front of the partition, and wherein the sealing member includes a first magnetic body and the inner case includes a second magnetic body corresponding to the first magnetic body and provided on an inner surface of the inner case that faces the body insulator, such that at the insertion position, the sealing member simultaneously contacts and is fixed to both the inner case and the partition by a magnetic force, and the partition includes a third magnetic body corresponding to the first magnetic body and provided on an inner surface of the partition that faces the partition insulator, such that at the insertion position, the sealing member is fixed to the partition by a magnetic force.

* * * * *